US010837452B2

(12) United States Patent
Huang et al.

(10) Patent No.: US 10,837,452 B2
(45) Date of Patent: Nov. 17, 2020

(54) AIR PUMP SYSTEM

(71) Applicant: Bestway Inflatables & Material Corp., Shanghai (CN)

(72) Inventors: Shuiyong Huang, Shanghai (CN); Wanbin Qiu, Shanghai (CN); Ruoxun Yin, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 234 days.

(21) Appl. No.: 15/992,118

(22) Filed: May 29, 2018

(65) Prior Publication Data

US 2019/0271322 A1 Sep. 5, 2019

(30) Foreign Application Priority Data

Mar. 2, 2018 (CN) ..... 2018 2 0297400 U

(51) Int. Cl.

| | |
|---|---|
| ***B65B 31/00*** | (2006.01) |
| ***F04D 25/12*** | (2006.01) |
| ***A47C 27/08*** | (2006.01) |
| ***F04B 45/047*** | (2006.01) |
| ***F04D 25/06*** | (2006.01) |
| ***F04D 27/00*** | (2006.01) |

(52) U.S. Cl.

CPC ..... *F04D 25/12* (2013.01); *A47C 27/083* (2013.01); *F04B 45/047* (2013.01); *F04D 25/0673* (2013.01); *F04D 27/008* (2013.01); *A47C 27/082* (2013.01); *F04C 2210/1005* (2013.01)

(58) Field of Classification Search

CPC ..... F04D 25/12; A47C 27/082; A47C 27/083

See application file for complete search history.

(56) References Cited

U.S. PATENT DOCUMENTS

| | | | | |
|---|---|---|---|---|
| 5,904,172 | A * | 5/1999 | Gifft | A47C 27/082 137/224 |
| 6,955,529 | B2 * | 10/2005 | Tsai | A47C 27/082 417/423.15 |
| 7,025,576 | B2 * | 4/2006 | Chaffee | A47C 27/082 417/366 |
| 7,128,525 | B2 * | 10/2006 | Tsai | F04D 25/08 415/128 |
| 7,475,443 | B2 * | 1/2009 | Wang | H01H 35/245 5/713 |
| 2007/0000569 | A1 * | 1/2007 | Wang | F16K 31/04 141/114 |

(Continued)

*Primary Examiner* — Reinaldo Sanchez-Medina

(74) *Attorney, Agent, or Firm* — AJ Moss; Dickinson Wright PLLC

(57) ABSTRACT

An air pump system includes a housing defining a first vent in fluid communication with an interior cavity of an inflatable member, a first one-way valve configured to open or close the first vent, a main pump having a main pump inlet and a main pump outlet, a valve control assembly for selectively opening or closing the one-way valve, an air pressure control assembly for sensing an air pressure of the interior cavity and generating a first air pressure signal when the air pressure reaches a first threshold air pressure, and generating a second air pressure signal when the air pressure reaches a second threshold air pressure, and a control device in electrical communication with the main pump, valve control assembly and the air pressure control assembly.

18 Claims, 20 Drawing Sheets

(56) References Cited

U.S. PATENT DOCUMENTS

| | | | | |
|---|---|---|---|---|
| 2007/0209119 | A1* | 9/2007 | Chun-Chu | A47C 27/082 5/713 |
| 2010/0247355 | A1* | 9/2010 | Pan | A47C 27/082 417/423.14 |
| 2011/0020149 | A1* | 1/2011 | Tsai | A47C 27/082 417/321 |
| 2012/0093662 | A1* | 4/2012 | Tsai | A47C 27/082 417/44.2 |
| 2014/0250597 | A1* | 9/2014 | Chen | A61G 7/018 5/600 |
| 2015/0316068 | A1* | 11/2015 | Tsai | F04B 35/04 417/44.1 |
| 2017/0280884 | A1* | 10/2017 | Liu | A47C 27/083 |

* cited by examiner

AIR PUMP SYSTEM

CROSS-REFERENCE TO RELATED APPLICATIONS

This application claims the priority of Chinese Patent Application No. 201820297400.7, filed Mar. 2, 2018, which is incorporated herein by reference in its entirety.

TECHNICAL FIELD

The present disclosure generally relates to an air pump system and, in particular, to an electric air pump system for inflating or deflating an inflatable member.

BACKGROUND

Inflatable members, such as inflatable beds, inflatable mattresses, inflatable boats, and inflatable toys are popular consumer products due to their light weight, foldability and portability. While conventional inflatable mattresses can be inflated to a final inflated degree, such a final inflated degree is generally fixed and predetermined. That is, alterations of inflation degrees are generally not possible. Further, in conventional systems, primary and supplementary inflation is generally performed by a single inflation pump that is not optimized for supplementary inflation, thus generating additional noise, electronic inefficiencies and vibrations.

In the case of an inflatable mattress, insufficient inflation can cause the inflatable mattress to offer poor support. However, over-inflation can cause the inflatable mattress to expand, deform and break. For existing inflatable members, in the absence of a pressure gauge, controlling an inflation degree can only be achieved by pressing the inflatable member during or after inflation. However, such a method is neither convenient nor accurate. Accordingly, conventional inflatable beds are limited in their functionality and flexibility, and do not purposefully and effectively address these constraints. Therefore, there is an urgent need in the art to provide a solution that can automatically sense the air pressure in the inflatable member.

SUMMARY

The present disclosure seeks to overcome some limitations and other drawbacks of the prior art, and to provide new features not heretofore available.

In some aspects, the present disclosure provides an air pump system including a housing defining a first vent in fluid communication with an interior cavity of an inflatable member, a first one-way valve configured to open or close the first vent and a main pump having a main pump inlet and a main pump outlet. The main pump inlet can be in fluid communication with an exterior of the inflatable member and the main pump outlet can be in fluid communication with the interior cavity via the first vent and a valve control assembly for selectively opening or closing the one-way valve. The valve control assembly can transmit a closed position signal when the one-way valve is in a closed position and the valve control assembly can transmit an open position signal when the one-way valve is in an open position. The air pump system can also include an air pressure control assembly for sensing an air pressure of the interior cavity and generating a first air pressure signal when the air pressure reaches a first threshold air pressure, and generating a second air pressure signal when the air pressure reaches a second threshold air pressure, and can further include a control device in electrical communication with the main pump, valve control assembly and the air pressure control assembly, the control device configured to transmit an operation signal to the main pump to operate when the air pressure sensed by the air pressure control assembly is below the first threshold air pressure and the control device configured to transmit a stop signal to the main pump to cease operating when the air pressure sensed by the air pressure control assembly reaches the first threshold air pressure.

The air pump system can further include a supplementary pump having a supplementary inlet in fluid communication with the exterior of the inflatable member and a supplementary outlet in fluid communication with the interior cavity via an air-supplementing vent in the housing, the supplementary pump being in electrical communication with the control device.

The air pump system can further include a base disposed on an outer surface defined by the inflatable member and configured to at least partially disposed in the interior cavity, the base releasably securing one or more of the housing, first one-way valve, main pump, valve control assembly, supplementary pump and air pressure control assembly to the inflatable member, wherein the base defines a base vent in fluid communication with the interior cavity and the first vent.

After the control device has transmitted a stop signal to the main pump to cease operating and the air pressure sensed by the air pressure control assembly reaches the second threshold air pressure, the control device can transmit a supplementary operation signal to the supplementary pump to operate, and the control device can transmit a supplementary stop signal to the supplementary pump to cease operating when the air pressure sensed by the air pressure control assembly reaches the first threshold air pressure.

The air pump system can further include an initiating device manipulable by a user, the initiating device being in electrical communication with the control device. Further, the initiating device can be disposed on a cover attached to the housing.

The control device can transmit an open signal to the valve control assembly to open the first one-way valve when the initiating device is activated. Further, the control device can transmit an operation signal to the main pump to operate when the initiating device is activated.

The air pump can system further including a battery in electrical communication with the control device. A cover can be attached to the housing, and the cover can include at least one of a charging port for supplying electrical energy to the rechargeable battery and an electrical energy-outputting port for supplying electrical energy to an external device.

A battery indicator can indicate a state of charge of the battery. A battery indicator control switch can selectively turn on and off the battery indicator.

An actuation of a closed position signal generating device in the valve control assembly can generate the closed position signal and an actuation of an open position signal generating device in the valve control assembly can generate the open position signal.

The valve control assembly can include a movable first arm for actuating the closed position signal generating device to generate the closed position signal.

The valve control assembly can include a movable second arm for actuating the open position signal generating device to generate the open position signal.

The air pressure control assembly can include a movable membrane assembly configured to generate displacement due to air pressure of the interior cavity and an external air pressure of the inflatable member, and an air pressure signal generating device for generating and transmitting the first or second air pressure signal, the air pressure signal generating device being activated by the movable membrane assembly.

The air pressure control assembly can include a movable membrane assembly and an air pressure signal generating device, and the movable membrane assembly can be configured to generate displacement due to an air pressure of the interior cavity and an external air pressure of the inflatable member, the air pressure signal generating device being in electrical communication with the control device, the membrane assembly can be further configured to activate the air pressure signal generating device to generate the first air pressure signal when the air pressure of the interior cavity reaches the first threshold air pressure and to activate the air pressure signal generating device to generate the second air pressure signal when the air pressure of the interior cavity reaches the second threshold air pressure.

The air pump system can further include a lock structure for releasably securing one or more of the housing, cover, first one-way valve, main pump, valve control assembly, air pressure control assembly, control device and supplementary pump into the base.

The valve control assembly can include a motor electrically coupled to the control device and an actuating mechanism coupled to the motor, wherein the motor can be configured to drive the actuating mechanism, the actuating mechanism being configured to actuate the first one-way valve to translate in an axial direction of the first vent to open or close the first vent, the actuating mechanism being configured to activate the closed position signal generating device to generate the closed position signal and to activate the open position signal generating device to generate the open position signal.

The motor can include a motor shaft, the actuating mechanism can include at least one gear member, and a rotatable cam can be configured to rotate about a cam rotation axis. The rotatable cam can defines a cam surface and a gear portion, and the motor shaft can be coupled to the at least one gear member for rotating the at least one gear member, and at least one of the gear members can be engaged with the gear portion so as to rotate the rotatable cam and thereby open or close the first vent through contact between the rotatable cam and a valve rod of the first one-way valve, the contact translating a valve plate of the first one-way valve along a first vent axis.

The air pump system according to the present disclosure can automatically sense the air pressure in the inflatable member, thereby avoiding damage caused by over-inflation of the inflatable member or discomfort caused by insufficient inflation of the inflatable member. The disclosed method is convenient and accurate. Further, the supplementary pump can automatically supplement air for the inflatable member, thereby preventing decreased air pressure from affecting comfort levels of the inflatable member.

BRIEF DESCRIPTION OF THE DRAWINGS

The present disclosure will now be described by way of example, with reference to the accompanying drawings in which implementations of the disclosures are illustrated and, together with the descriptions below, serve to explain the principles of the disclosure.

DETAILED DESCRIPTION

Figure 1:
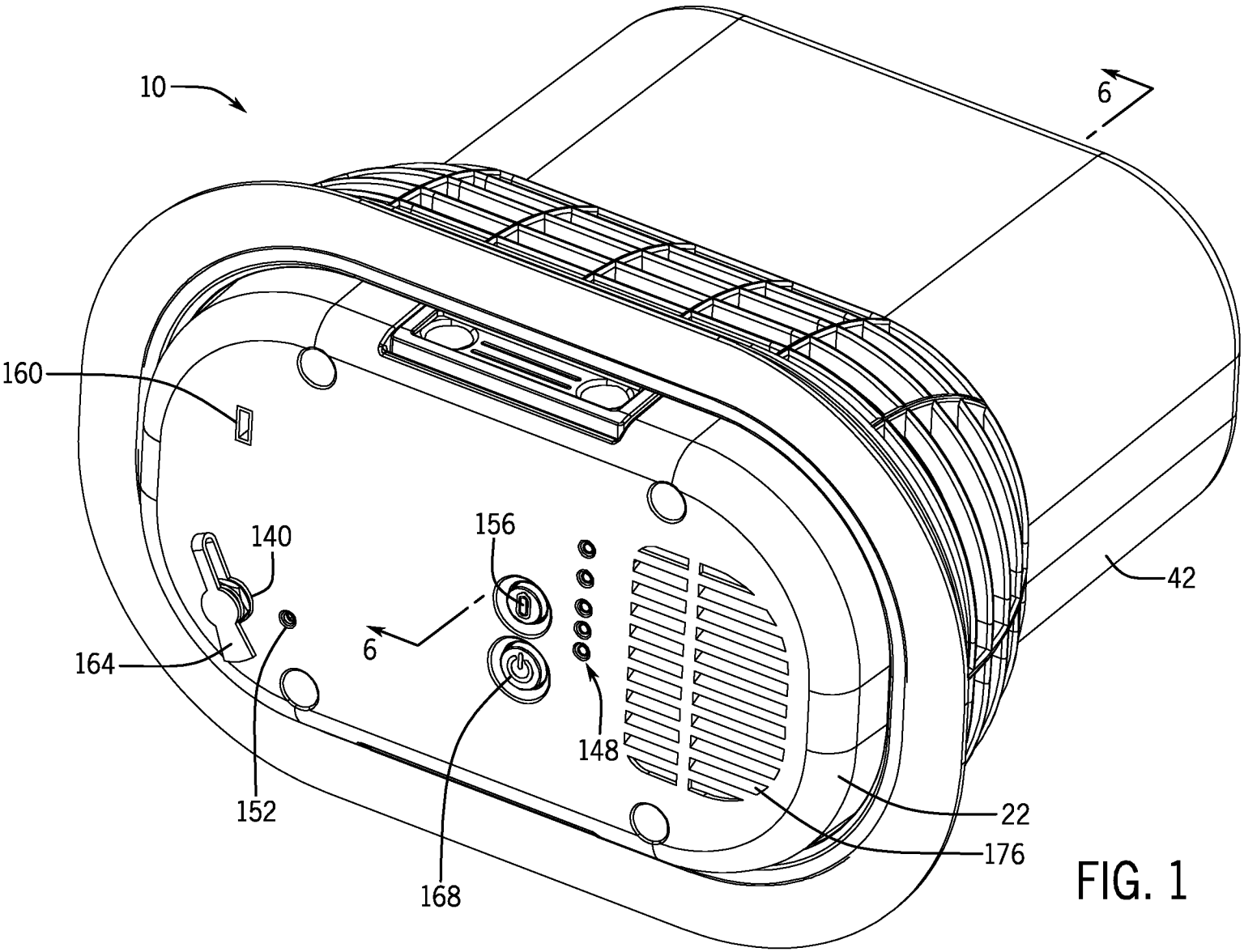
FIGS. 1 and 2 are perspective views of an air pump system according to exemplary implementations of the present disclosure.
Figure 2:
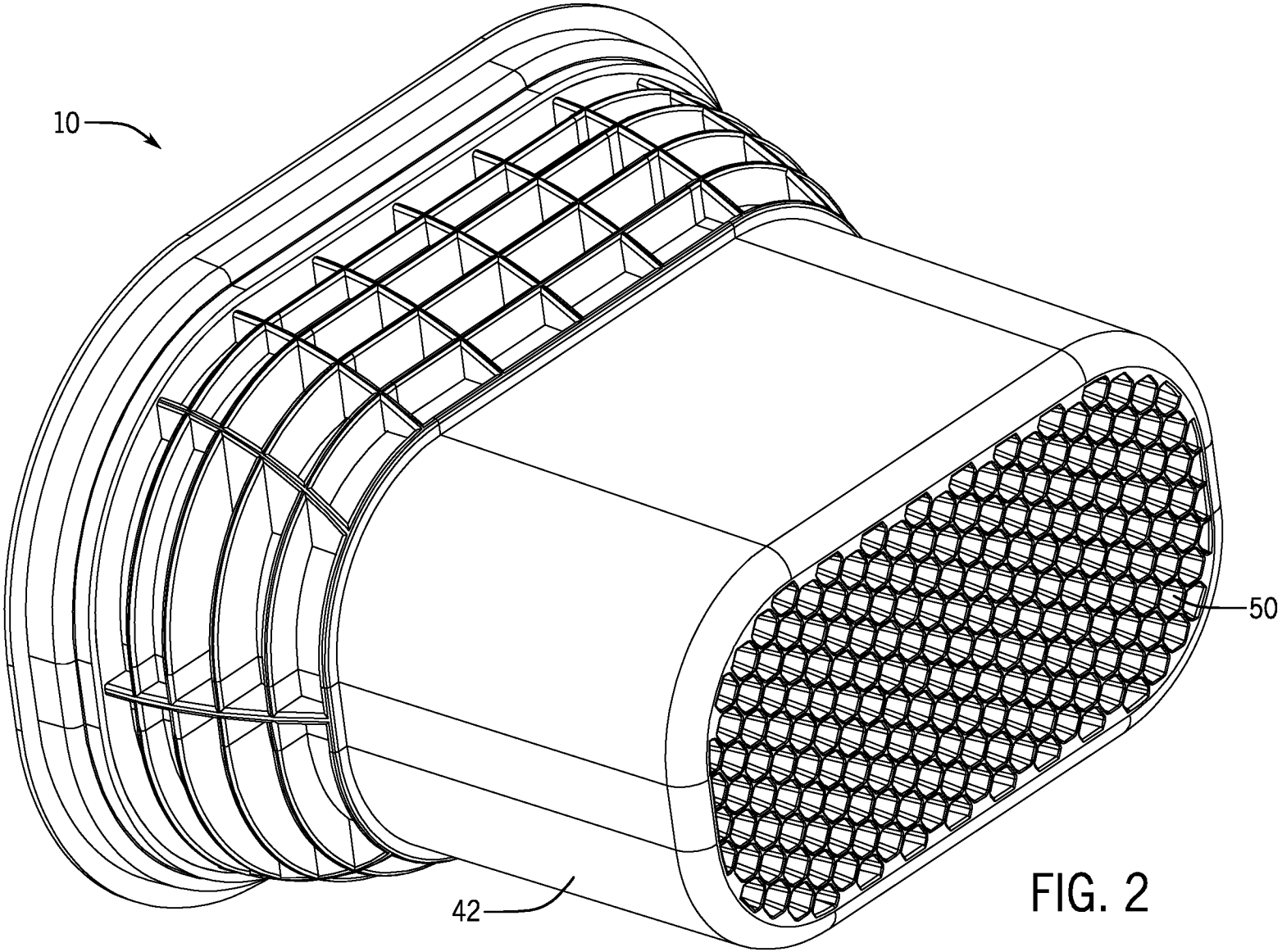
Figure 3:
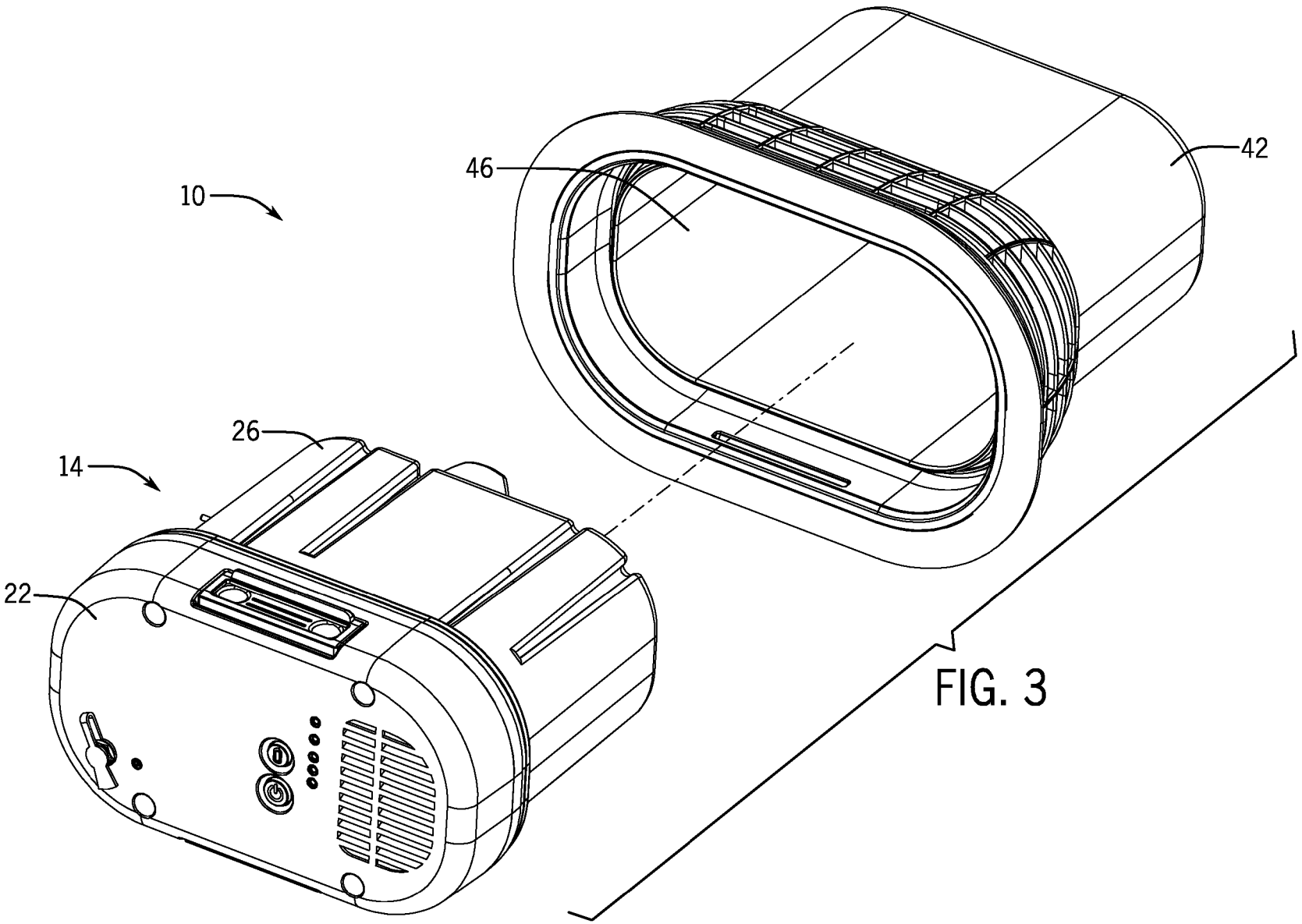
FIG. 3 is an exploded perspective view of the air pump system of FIGS. 1 and 2, showing a base separated from an air pump assembly.
Figure 4A:
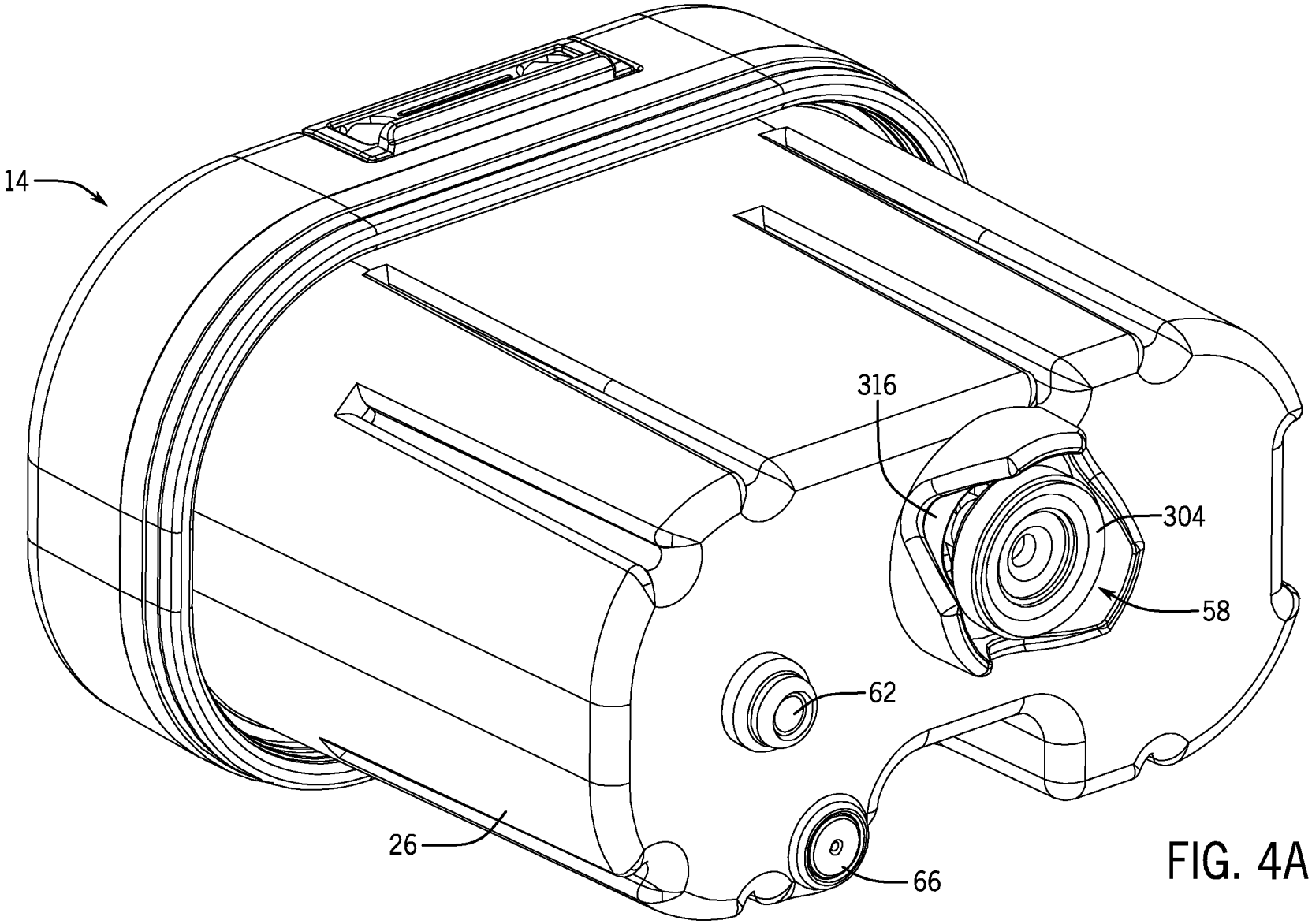
FIG. 4A is a rear perspective view of the air pump assembly of FIG. 3.
Figure 4B:
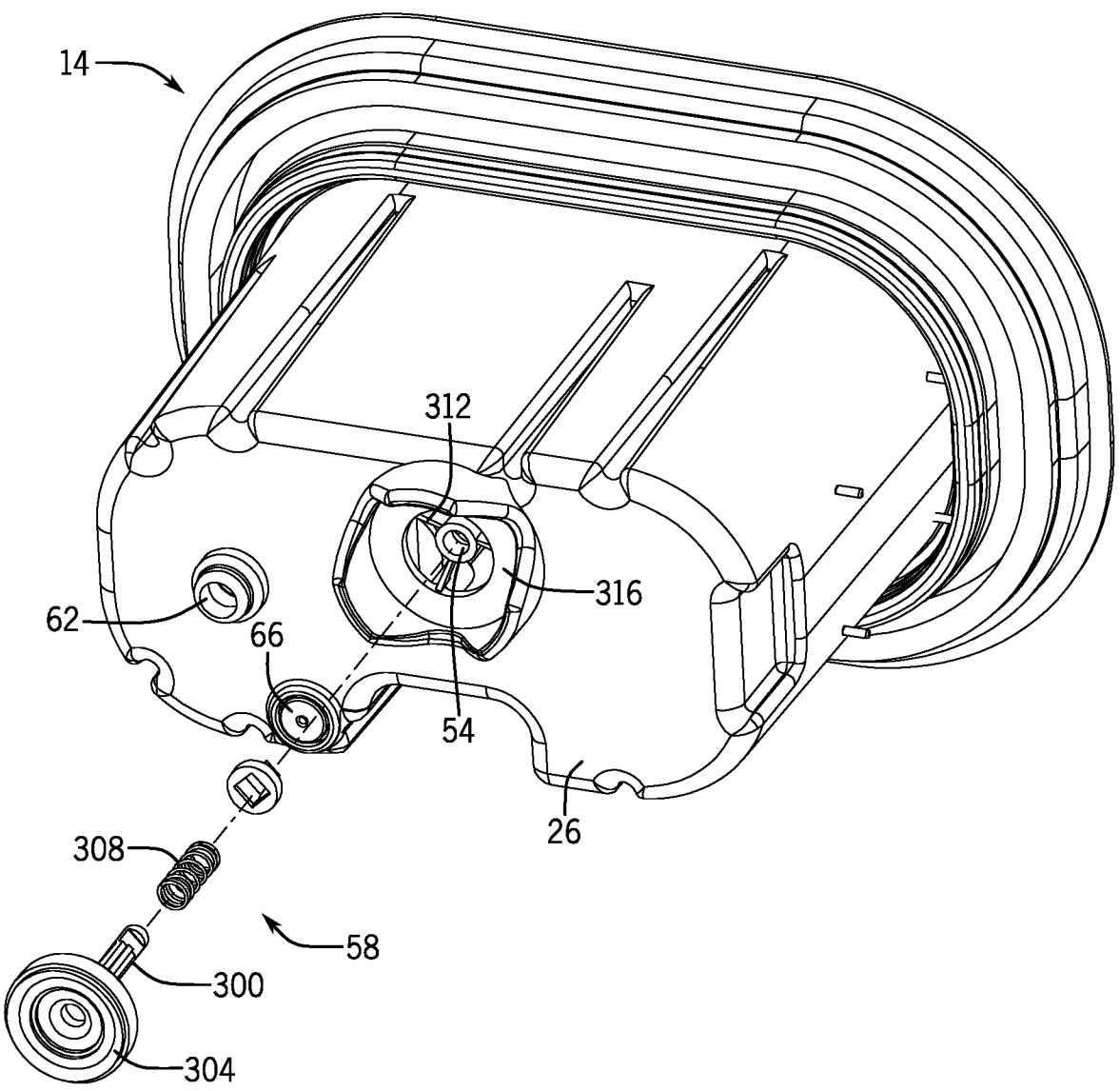
FIG. 4B is a rear perspective view of the air pump assembly of FIG. 3 showing an exploded first one-way valve.
Figure 5A:
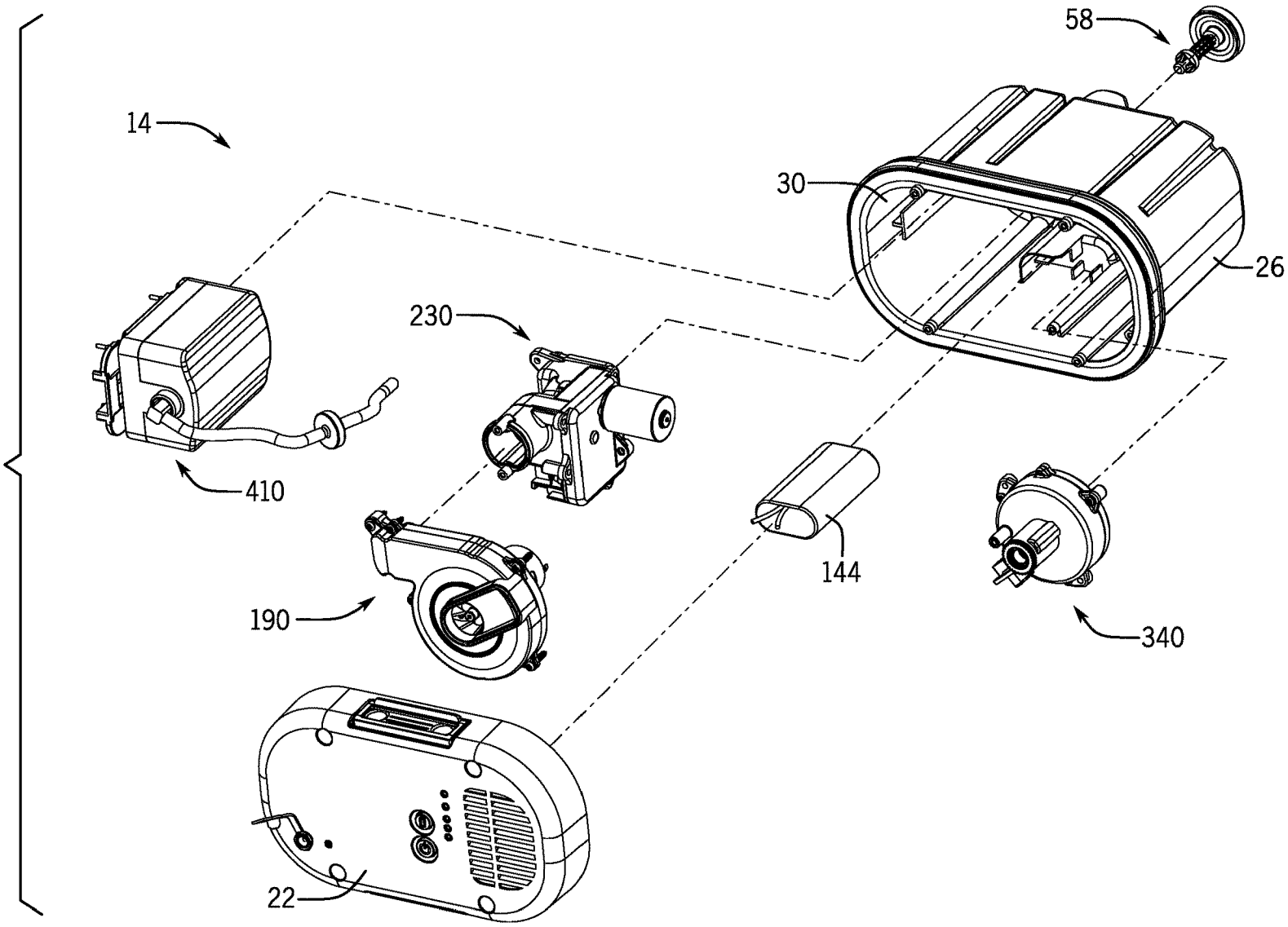
FIG. 5A is an exploded perspective view of the air pump assembly of FIG. 3, in particular showing a battery, top cover, housing, supplementary pump, air pressure control assembly, main pump and valve control assembly.
Figure 5B:
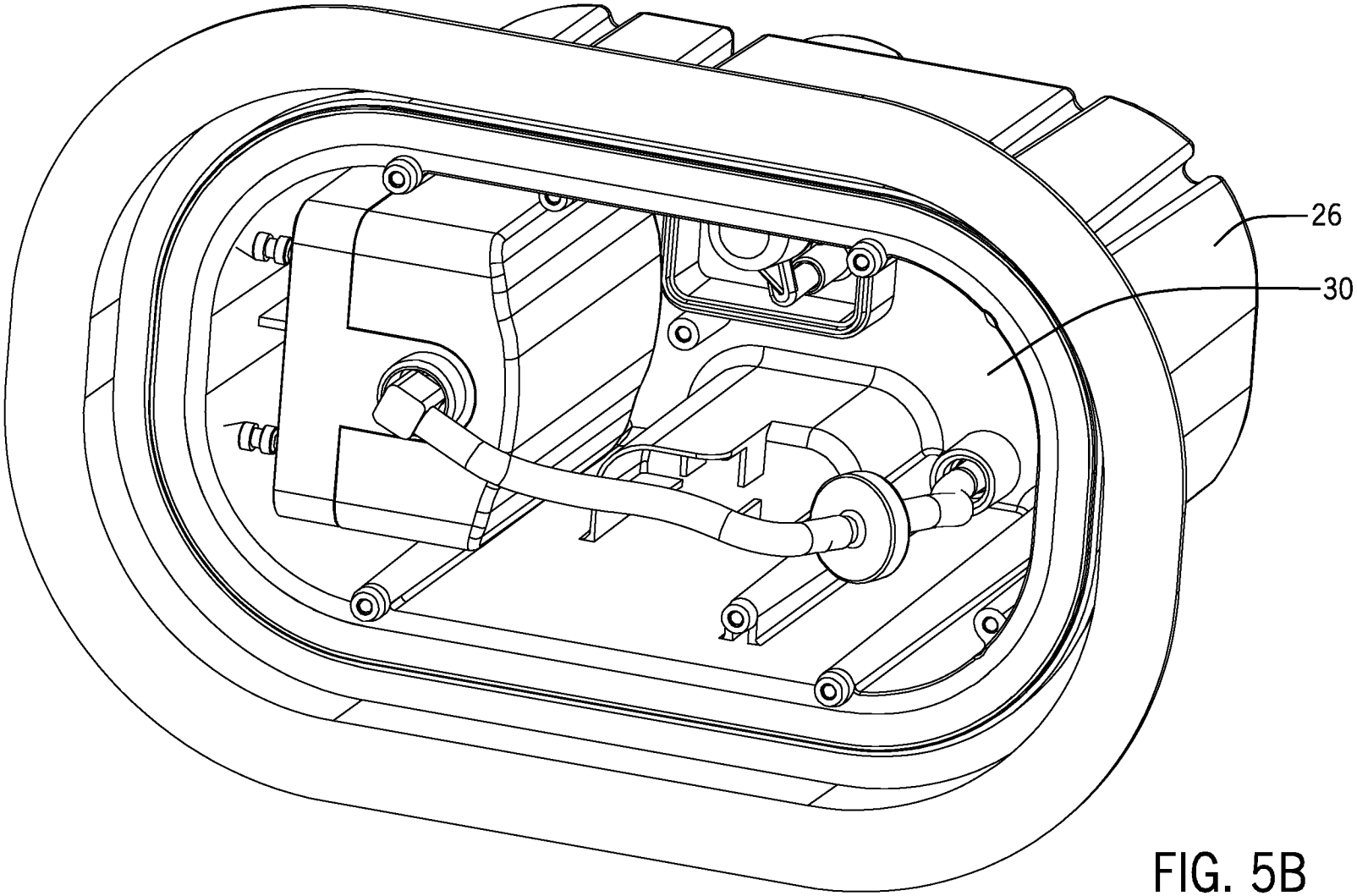
FIG. 5B is a perspective view of the air pump assembly of FIG. 3, showing the supplementary pump disposed in the housing.

While the air pump system discussed herein may be implemented in many different forms, the disclosure will show in the drawings, and will herein describe in detail, implementations with the understanding that the present description is to be considered as an exemplification of the principles of the air pump system and is not intended to limit the broad aspects of the disclosure to the implementations illustrated. Accordingly, the drawings and description are to be regarded as illustrative in nature and not restrictive.

Referring now to the figures, and initially to FIGS. 1-6 and 17, an air pump system 10 is disclosed. The air pump system 10 includes, in some implementations, an air pump assembly 14 releasably connected to an inflatable member 18. The air pump assembly 14 includes a cover 22 releasably attached to a housing 26. The housing 26 defines a housing cavity 30, within which certain elements of the air pump system 10 are disposed, as will be described in detail below.

The inflatable member 18, which can be an inflatable bed or an inflatable mattress, is at least partially defined by an outer surface 34 defining an interior cavity 38. As is commonly known in the art, the outer surface 34 can bound, contain, hermetically seal and/or substantially hermetically seal a pressurized fluid within the interior cavity 38. The pressurized fluid can be air, although other fluids such as nitrogen are within the scope of this disclosure.

A base 42 defines a base cavity 46, and the base 42 is connected to a portion of the outer surface 34 and at least partially in the interior cavity 38. The base cavity 46 is in fluid communication with an interior cavity 38 of the inflatable member 18. The air pump assembly 14, in some implementations, is received by the base cavity 46 and releasably secured to the base 42 by a lock structure 90, described in detail below. A base vent 50 is defined in a surface of the base 42 and enables fluid communication between the base cavity 46 and interior cavity 38.

A first vent 54, air pressure measurement vent 62 and air supplementing vent 66 are each defined in the housing 26, and each of the first vent 54, air pressure measurement vent 62 and air supplementing vent 66 facilitate fluid communication between the housing cavity 30 and the base cavity 46, and thus between the housing cavity 30 and the interior cavity 38 via the base vent 50. A first one-way valve 58 is disposed at least partially within the first vent 54 and can selectively prevent, or substantially prevent, fluid flow through the first vent 54.

Figure 6:
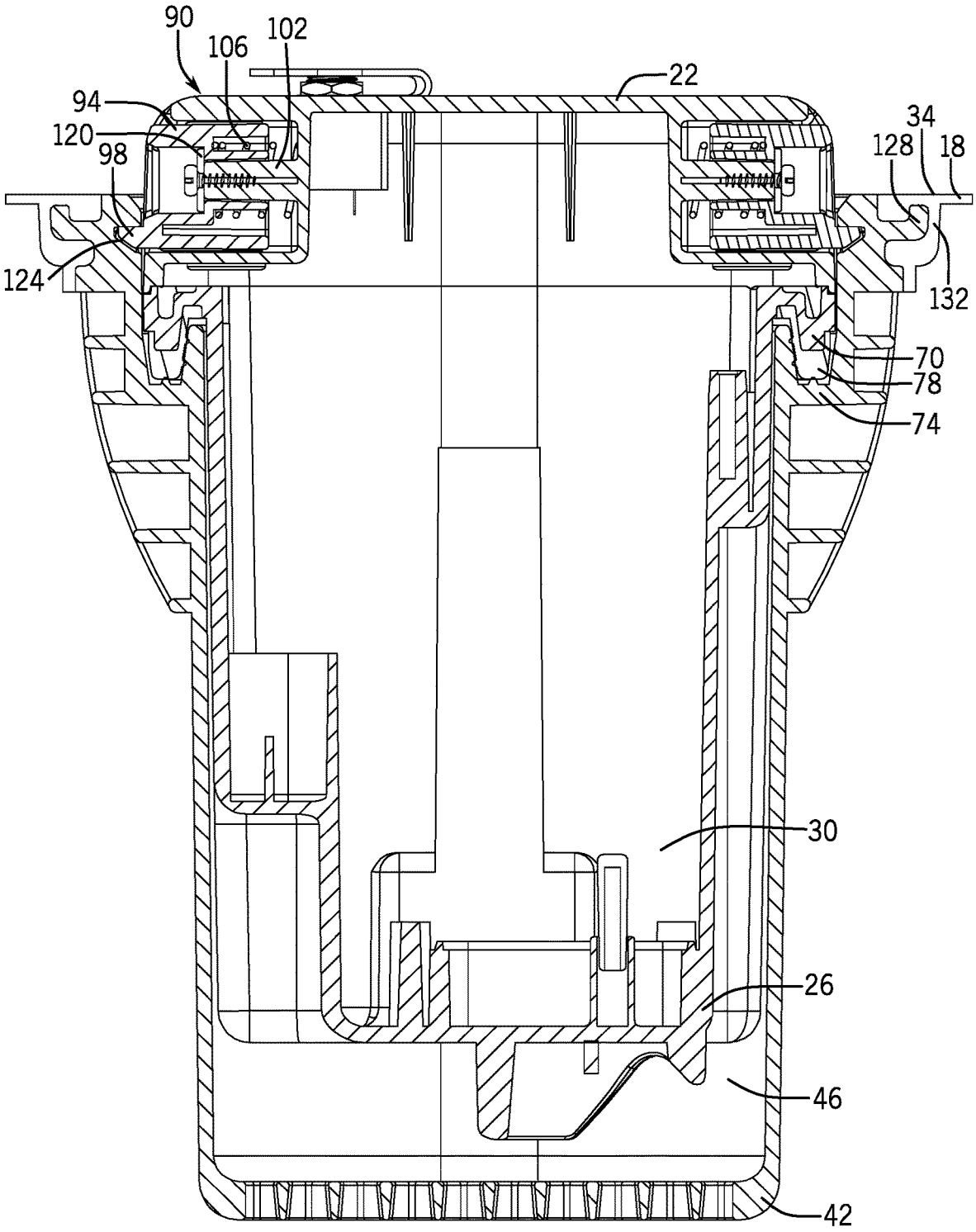
FIG. 6 is a cross-sectional view of the air pump system of FIG. 1, taken along line 6-6 of FIG. 1.

The housing 26 defines housing seal flange 70 which can engage with, or can be at least partially disposed within, a base groove 74 formed in the base 42 when the base 42 is releasably connected to the air pump assembly 14, as exemplarily shown in FIG. 6. A gasket 78 can be disposed at least partially between the base groove 74 and housing seal flange 70 to form a complete fluid seal between the housing 26 and base 42.

The air pump assembly 14 is releasably secured to the base 42 via a lock structure 90, best seen in FIG. 6. In particular, a sliding lock 94 defines a locking tab 98. The sliding lock 94 is at least partially disposed adjacent, around or proximate a sliding lock guide 102 formed in or on the cover 22. A sliding lock spring 106 is sleeved around the sliding lock guide 102 and can apply a biased force, outwardly from the cover 22, against the sliding lock 94. A baffle 120 can be disposed on the sliding lock guide 102 to limit travel of the sliding lock 94 when the sliding lock 94 is manipulated by a user. A locking tab slot 124, defined in the base 42, receives at least a portion of the locking tab 98 to thereby secure the air pump assembly 14 to the base 42. Such an arrangement is shown in FIG. 6.

In an exemplary operation, the air pump assembly 14 is releasably secured to the base 42 due to the locking tab 98 being at least partially disposed within the locking tab slot 124. A user, or other force, then manipulates the sliding lock 94 and translates the sliding lock 94 along the sliding lock guide 102 towards the cover 22, and against the biasing force of the sliding lock spring 106. This sliding lock 94 translation causes the locking tab 98 to be disposed outward of the locking tab slot 124 and the air pump assembly 14 can then be removed from the base cavity 46.

Further, the air pump assembly 14 can then be inserted into the base cavity 46. In some implementations, an angled shape of the locking tab 98 and/or base 42 enables the air pump assembly to simply be inserted into the base cavity and simultaneously causes the sliding lock 94 to be translated as described above. In some implementations, a user manipulation or other force is required to insert the air pump assembly 14 into the base cavity 46. Regardless, once the air pump assembly 14 is inserted into the base cavity 46, the sliding lock 94 translates outwardly from the cover 22 and causes the locking tab 98 to be at least partially disposed within the locking tab slot 124, thus releasably securing the air pump assembly 14 to the base 42.

FIG. 6 also shows a base securement flange 128, formed on the base 42, and abase securement portion 132, which can be made of flexible thermoplastic material. In particular, the base securement flange 128 can be joined with the base securement portion 132 by second molding to thereby secure the base 42 to the outer surface 34 of the inflatable member 18. The base securement flange 128 and the base securement portion 132 can be joined by adhesives, welding or any other mechanical or chemical joining technique commonly known to those skilled in the art.

Figure 7:
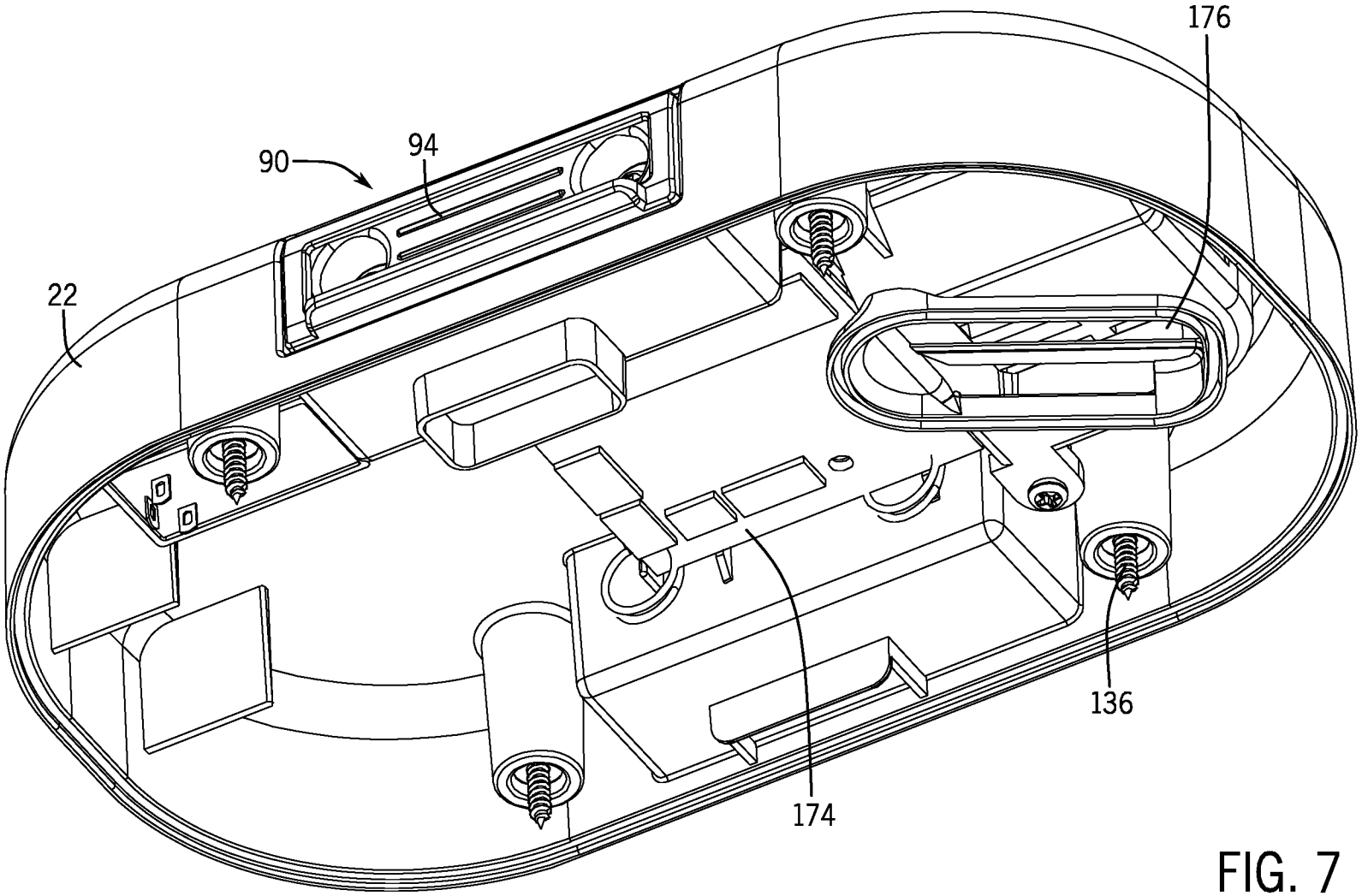
FIG. 7 is a lower perspective view of the top cover of FIG. 5A.

Turning to FIGS. 1 and 7, the cover 22 is joined with the housing 26 by a cover attachment mechanism 136, shown exemplarily as screws in FIG. 7. It is to be understood that any adhesive, mechanical or chemical joining technology is within the scope of this disclosure. The cover 22 can include a charging port 140 for charging a battery 144 and a battery charge indicator 148 for indicating a charge level of the battery 144. An external power source, such as electrical grid power, can provide electrical energy through the charging port 140 to charge the battery 144 and/or operate any element of the air pump system 10. The battery charge indicator 148 can include one or more lights that illuminate, change color, change brightness or change an operation pattern (such as flashing patterns) to indicate a charge level of the battery 144. In particular, the battery charge indicator 148 can include three lights: three illuminated lights can indicate the battery 144 is fully charged, only two illuminated lights can indicate a partial, or moderate, battery 144 charge and only one illuminated light (or only one illuminated flashing light) can indicate a low battery 144 charge. The battery charge indicator 148 can also include a screen, audible signal or other technology to convey a current charge level of the battery 144. A battery charge indicator control 156 selectively commands the battery charge indicator 148 to assess and display the current charge level of the battery 144, or alternatively commands the battery charge indicator 148 not to operate.

A charging indicator 152, for indicating whether the battery 144 is being charged via the charging port 140, is also disposed on the cover 22. The charging indicator 152 can include a light, screen, audible signal or other technology to convey that the battery 144 is being charged.

An electrical energy outputting port 160 can also be disposed on the cover 22. The electrical energy outputting port 160, which can be a Universal Serial Bus port, enables the charging of an external device, which can be a mobile device, from one or more of the battery 144 and the electrical energy provided to the air pump system 10 via the charging port 140. A water-proof plug 164 can be disposed on or adjacent the charging port 140 and/or the electrical energy outputting port 160 to selectively prevent water, or other substances, from entering the charging port 140 and electrical energy outputting port 160.

The cover 22 can also include an initiating device 168, which can be a button, for commanding elements of the air pump system 10 to operate. A control device 174 is also disposed on the cover 22, and is in electrical communication with elements of the air pump system 10 as will be described below in further detail. Finally, the cover 22 also defines a cover vent 176 allowing fluid communication between an exterior of the air pump assembly 14 and the housing cavity 30.

Figure 8:
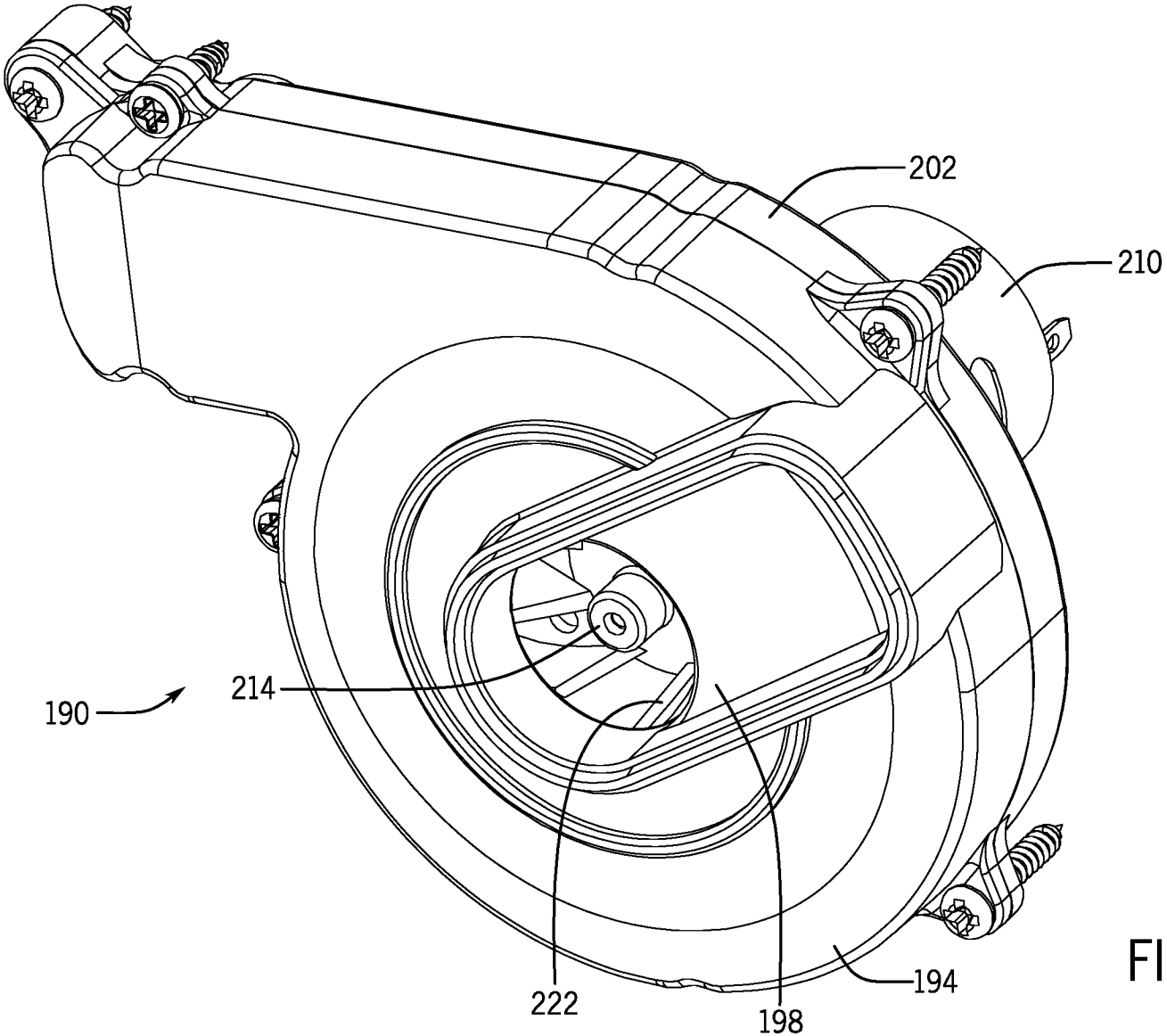
FIG. 8 is a perspective view of the main pump of FIG. 5A.
Figure 9:
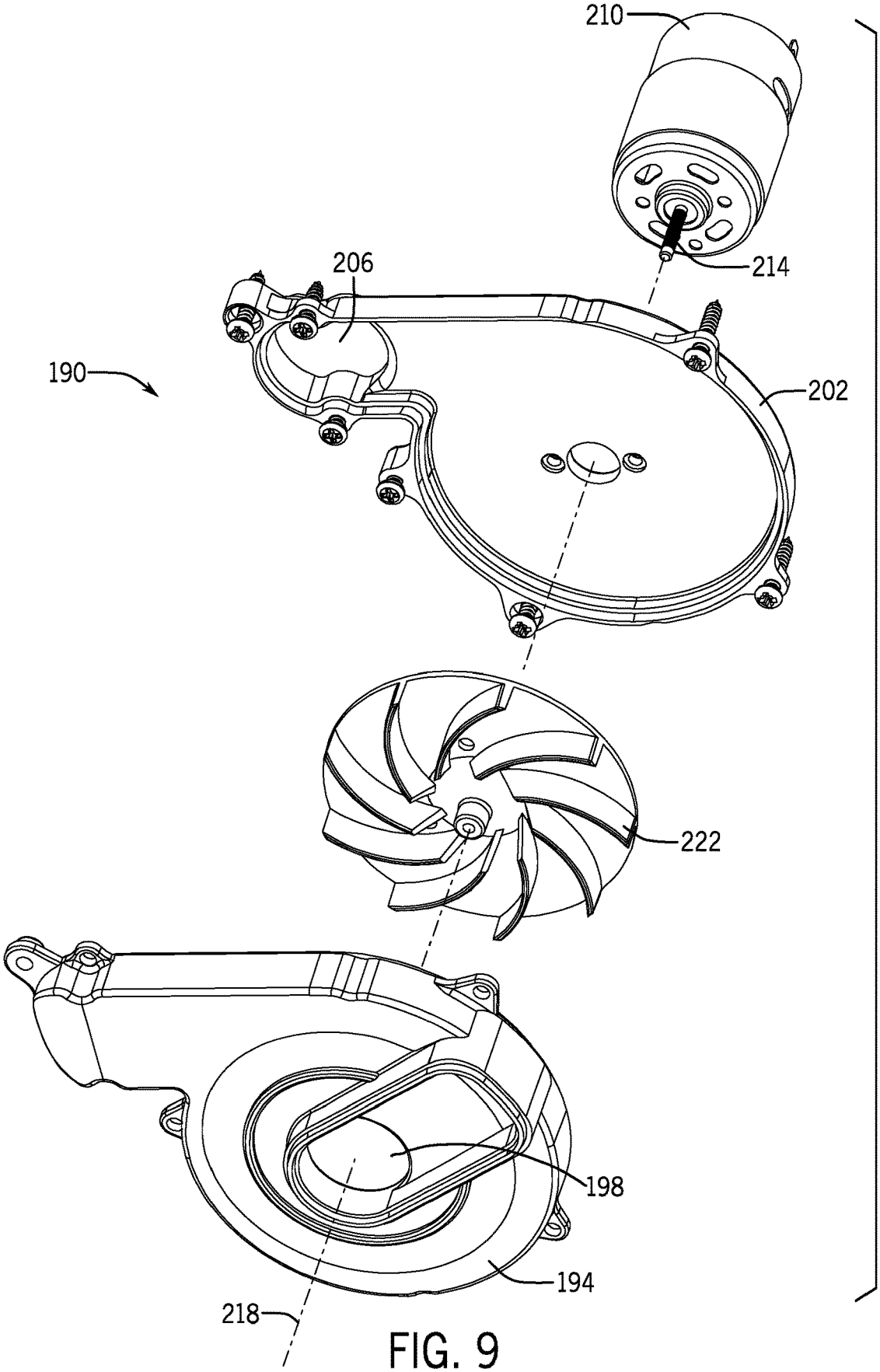
FIG. 9 is an exploded perspective view of the main pump of FIG. 8.
Figure 10A:
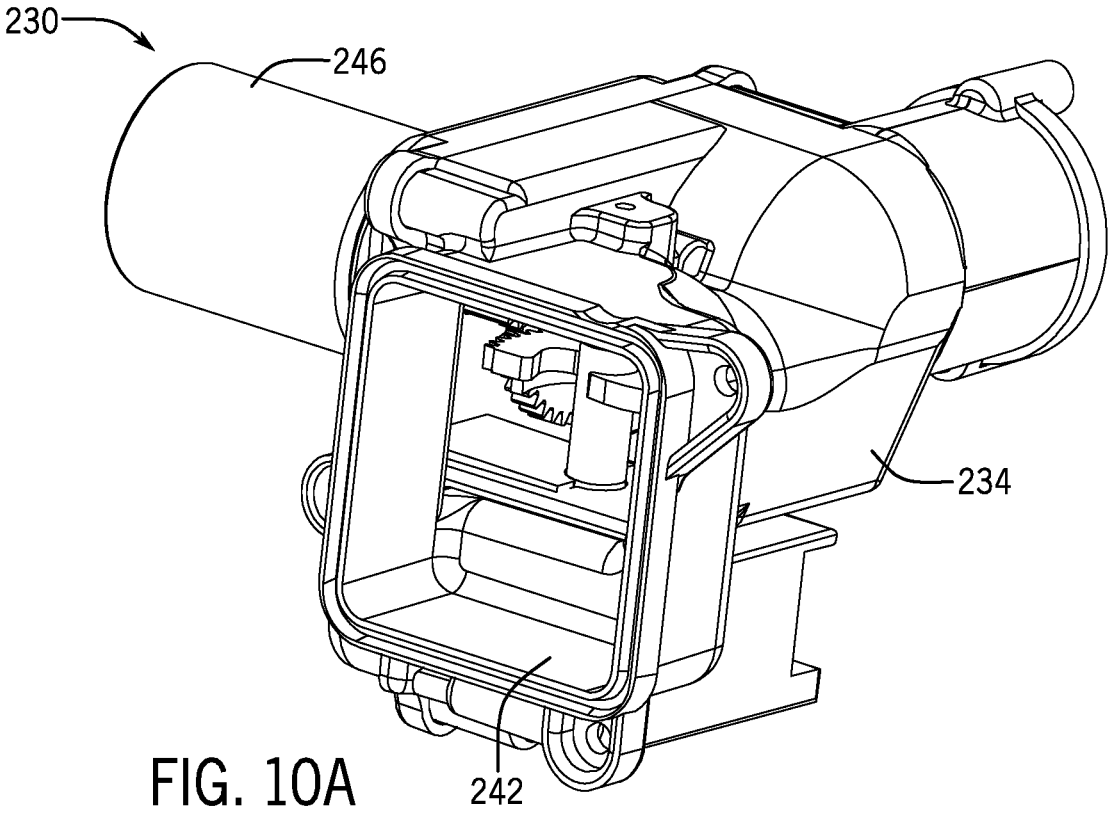
FIGS. 10A and 10B are perspective view of the valve control assembly of FIG. 5A.
Figure 10B:
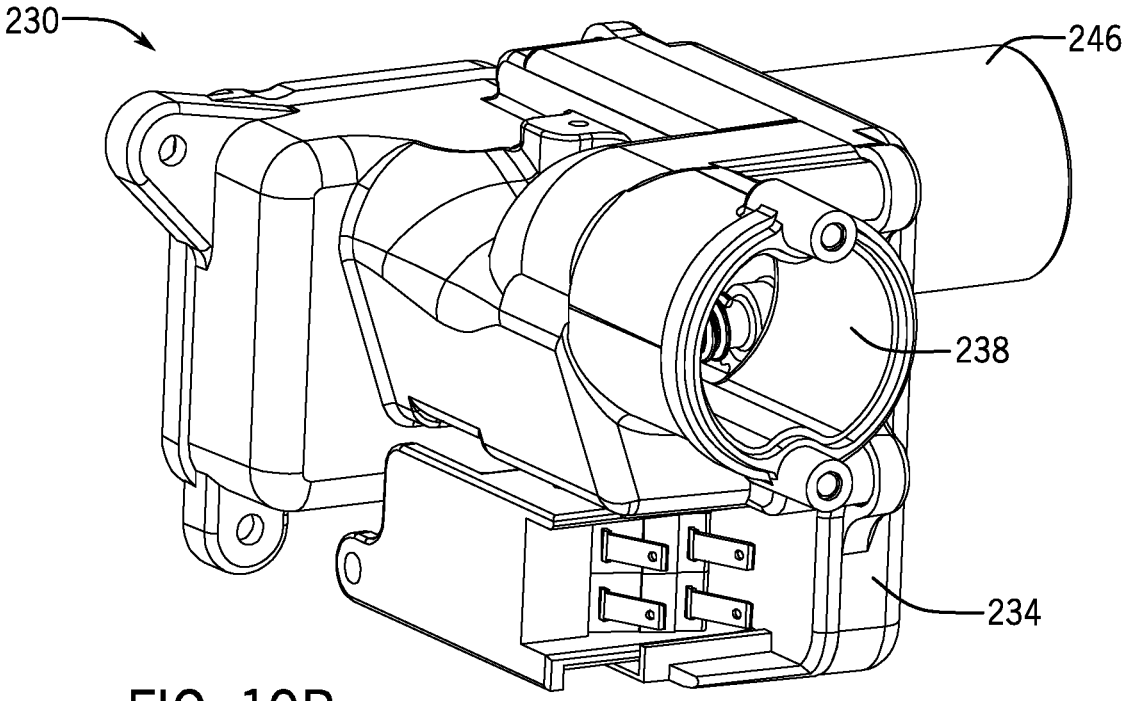
Figure 11:
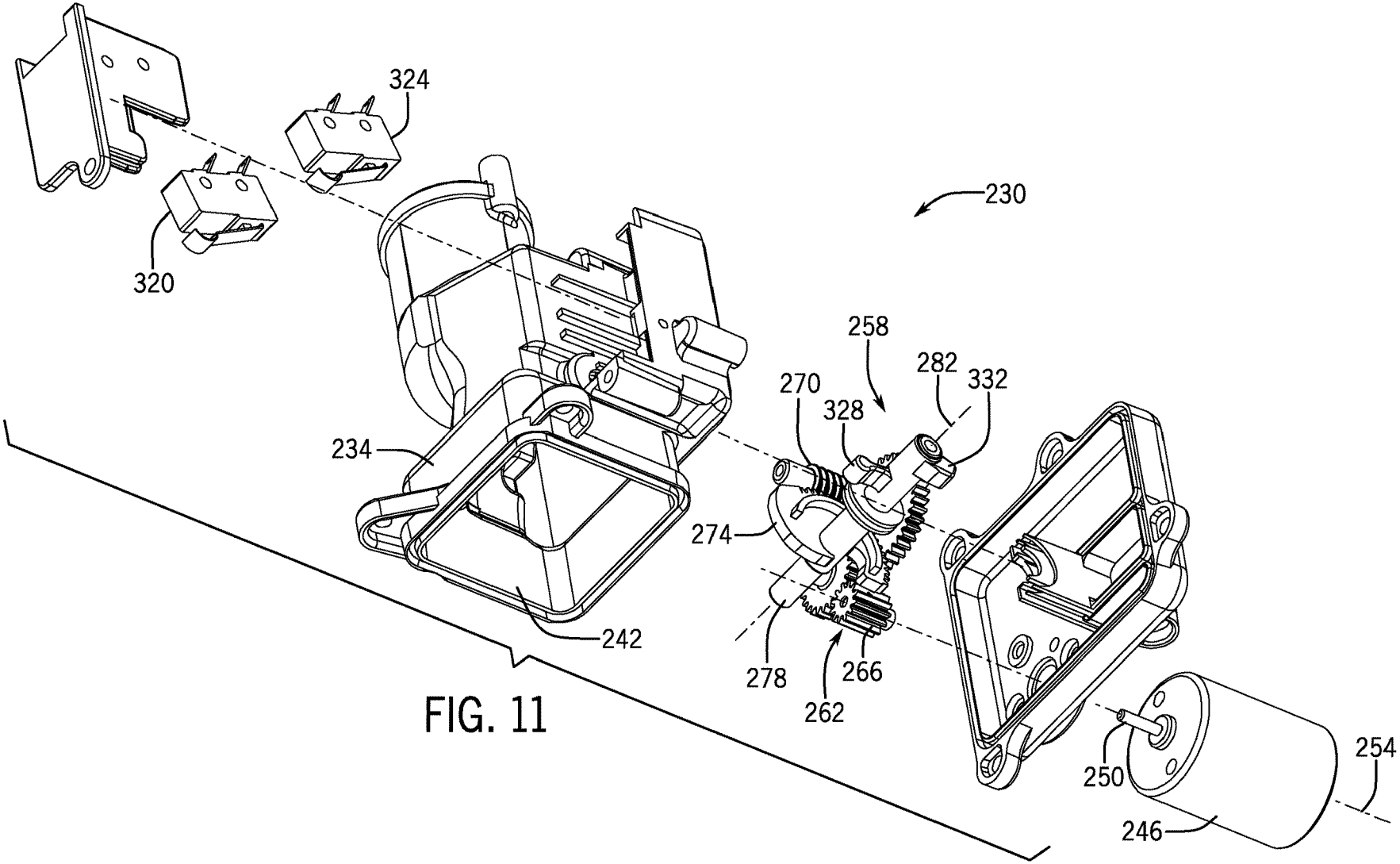
FIG. 11 is an exploded perspective view of the valve control assembly of FIGS. 10A and 10B.

FIGS. 8 and 9 illustrate perspective and exploded perspective views of a main pump 190. The main pump 190 includes a main pump inlet housing 194 defining a main pump inlet 198, and a main pump outlet housing 202 defining a main pump outlet 206. The main pump inlet 198 can be in fluid communication with an exterior of the inflatable member 18 via the cover vent 176 defined in the cover 22.

The main pump 190 can also include a main pump motor 210, which can be an electrical motor, and a main pump motor shaft 214 rotated by the main pump motor 210 about a main pump motor shaft axis 218. The main pump motor shaft 214 is connected to a main pump fan 222 such that a rotation of the main pump motor 210 rotates each of the main pump motor shaft 214 and main pump fan 222.

A valve control assembly 230, exemplarily shown in FIGS. 10A-13B, includes a valve control assembly housing 234 defining a valve control assembly inlet 238 and a valve control assembly outlet 242. In some implementations, the valve control assembly inlet 238 is connected to, and/or in fluid communication with, the main pump outlet 206. The valve control assembly 230 can also include a valve control motor 246, which can be an electric motor, and a valve control shaft, or a motor shaft, 250 rotated by the valve control motor 246 about a valve control shaft axis 254.

An actuating mechanism 258 transmits rotational forces from the valve control motor 246 to the first one-way valve 58. The actuating mechanism 258 can be at least partially disposed within the valve control assembly housing 234. The actuating mechanism 258 can include a drive train 262 having one or more gear members 266 and a worm gear 270. The rotatable cam 274 includes a cam shaft 278 disposed substantially along a cam shaft rotation axis 282, and further includes a gear portion 286 and a cam surface 290. However, it is to be understood that other mechanical systems and arrangements for transmitting mechanical energy from the valve control motor 246 to the first one-way valve 58 are within the scope of this disclosure.

Figure 12A:
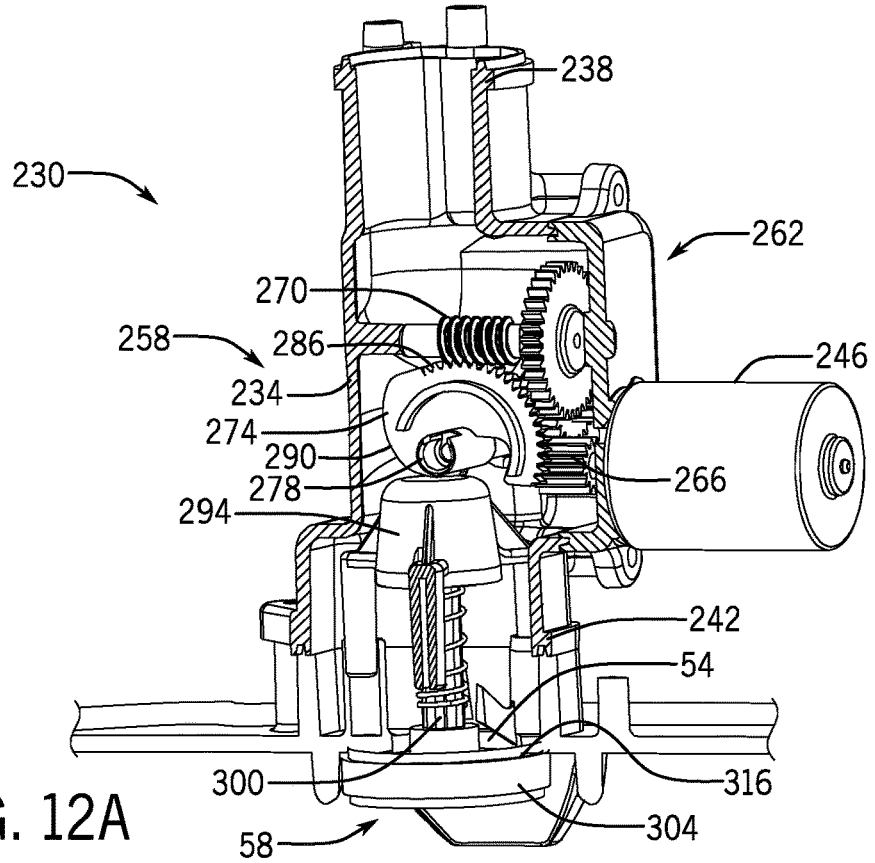
FIG. 12A is a perspective view of elements of the valve control assembly of FIGS. 10A and 10B, in particular showing a first one-way valve in a closed position.
Figure 12B:
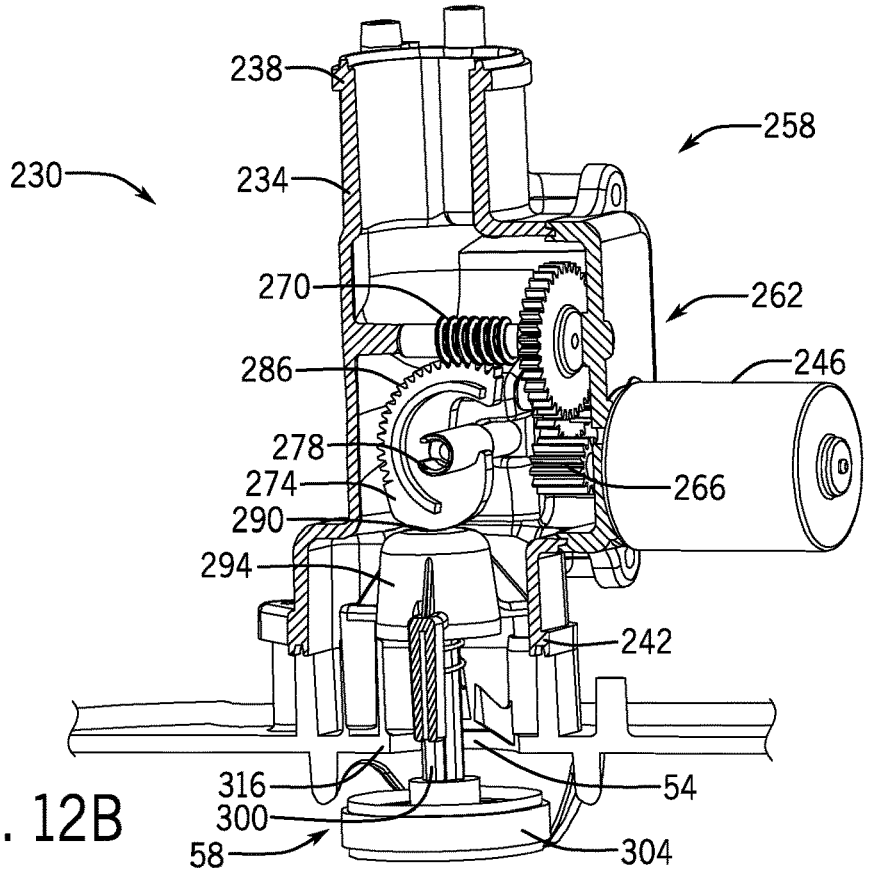
FIG. 12B is a perspective view of elements of the valve control assembly of FIGS. 10A and 10B, in particular showing a first one-way valve in an open position.

In operation, rotations of the valve control motor 246 are transmitted, via the drive train 262 to the rotatable cam 274. The engagement of the worm gear 270 with the gear portion 286 causes the rotatable cam 274 to rotate about the cam shaft rotation axis 282. The cam surface 290 is defined on at least a portion of the rotatable cam 274 and thus rotates along with the rotatable cam 274 between a closed position (FIGS. 12A, 13A) and an open position (FIGS. 12B, 13B). As the cam surface 290 rotates from the closed position to the open position, the cam surface 290 acts on the locking piece 294 of the first one-way valve 58 and translates the locking piece 294 away from the first vent 54. When the cam surface 290 rotates from the open position to the closed position, the locking piece 294 translates towards the first vent 54.

The locking piece 294 is connected to one end of the valve shaft 300 of the first one-way valve 58. A valve plate 304 is connected to another end of the valve shaft 300, when the cam surface 290 acts on the locking piece 294 and translates the locking piece 294, the movement of the valve shaft 300 along with the locking piece 294 drives the valve plate 304 to translate in the axial direction of the first air vent 54 to open or close the first air vent 54. The housing 26 can include a support 312 in the first vent 54 for supporting a sliding motion in an aperture of the valve shaft 300. When the rotatable cam 274 is disposed in the closed position, the first one-way valve 58 is also disposed in the closed position (FIG. 12A) and when the rotatable cam 274 is disposed in the open position, the first one-way valve 58 is also disposed in the open position (FIG. 12B).

Further, the housing 26 can also define a seal surface 316 which forms a complete, substantially-complete or partial fluid seal with the valve plate 304 when the rotatable cam 274 and first one-way valve 58 are disposed in the closed position. Fluid is thus prevented from passing through the first vent 54 via the first one-way valve 58 when the rotatable cam 274 and first one-way valve 58 are disposed in the closed position. When the rotatable cam 274 and first one-way valve 58 are disposed in the open position, no fluid seal is formed between the valve plate 304 and seal surface 316, and fluid is thus allowed to pass through the first vent 54. A valve shaft spring 308 is sleeved outside the valve shaft 300 and disposed between the valve plate 304 and the locking piece 294, which can be sleeved around the valve shaft 300, can bias the first one-way valve 58 towards the closed position.

The valve control assembly 230 can include a closed position signal generating device 320 and an open position signal generating device 324, and can further include a movable first arm 328 and a movable second arm 332. Each of the movable first arm 328 and movable second arm 332 are disposed on the rotatable cam 274, and more particularly on the cam shaft 278. As the rotatable cam 274 rotates about the cam shaft rotation axis 282, each of the movable first arm 328 and movable second arm 332 also rotates about the cam shaft rotation axis 282.

Figure 13A:
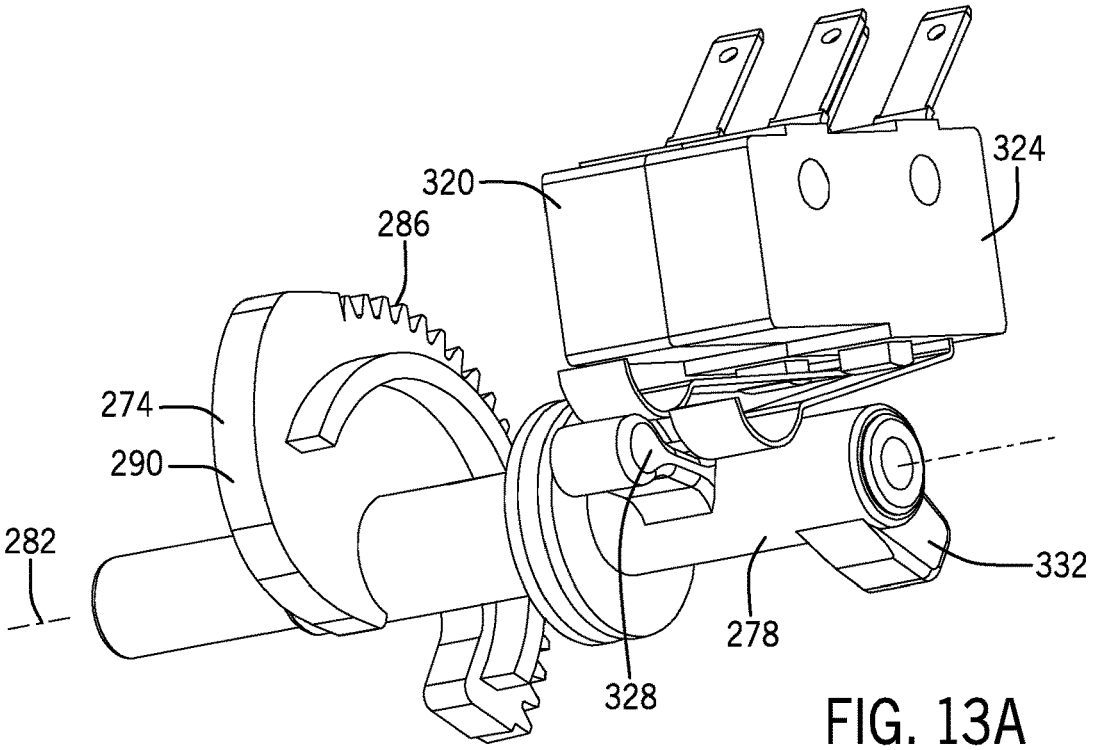
FIG. 13A is a perspective view of elements of the valve control assembly of FIGS. 10A and 10B, in particular showing a first movable arm engaging a closed position signal generating device.
Figure 13B:
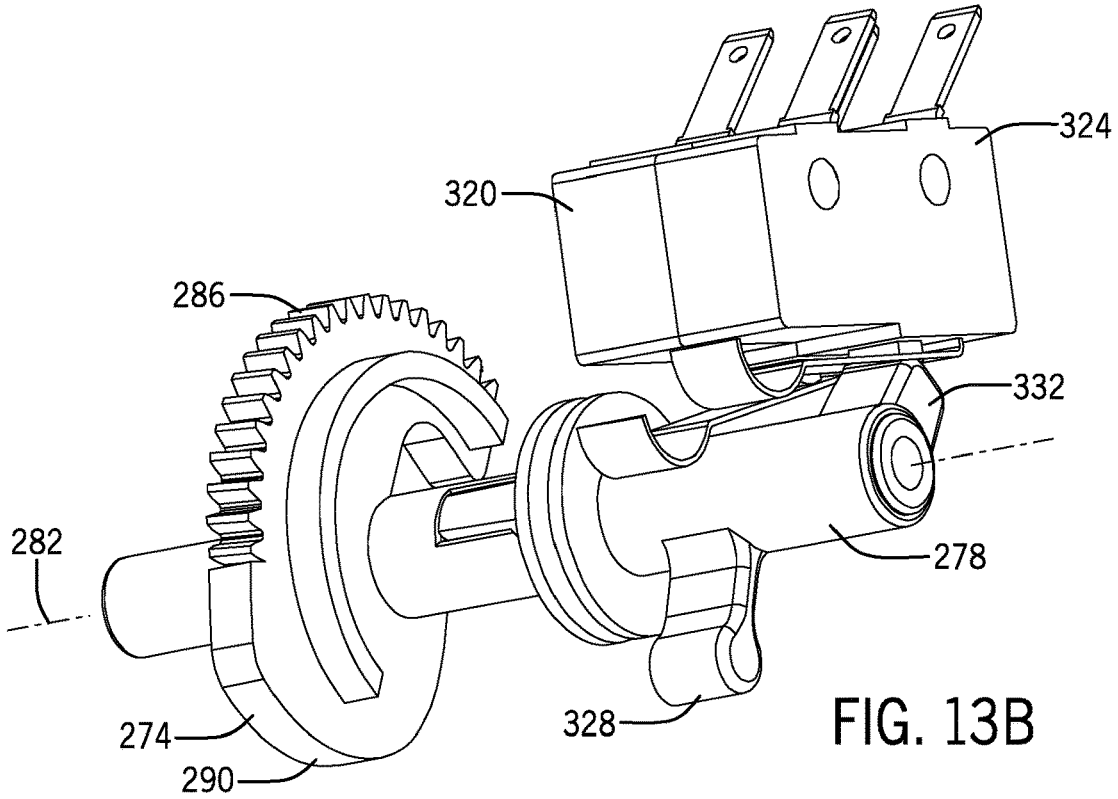
FIG. 13B is a perspective view of elements of the valve control assembly of FIGS. 10A and 10B, in particular showing a second movable arm engaging an open position signal generating device.
Figure 14A:
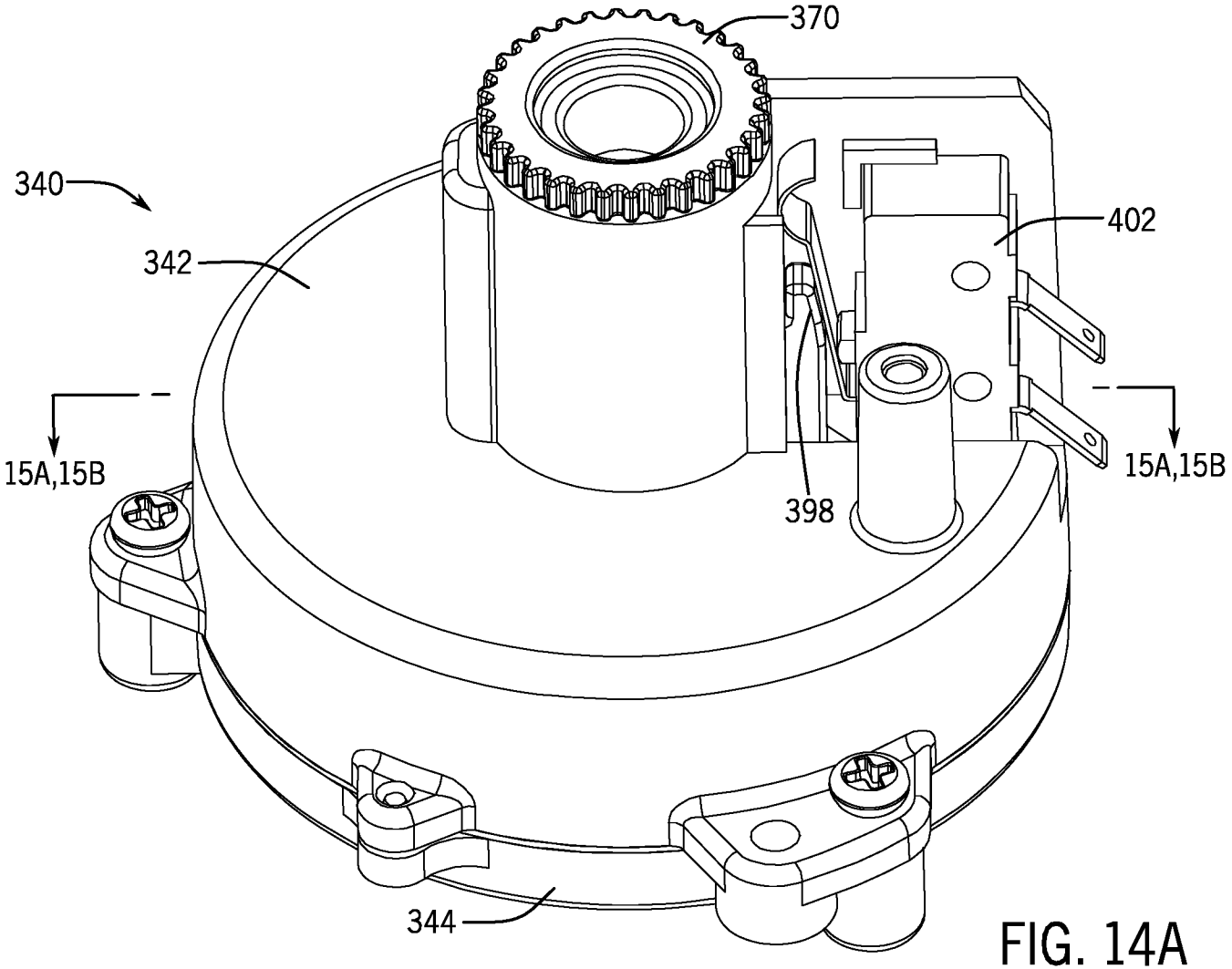
FIG. 14A is an upper perspective view of the air pressure control assembly of FIG. 5A.
Figure 14B:
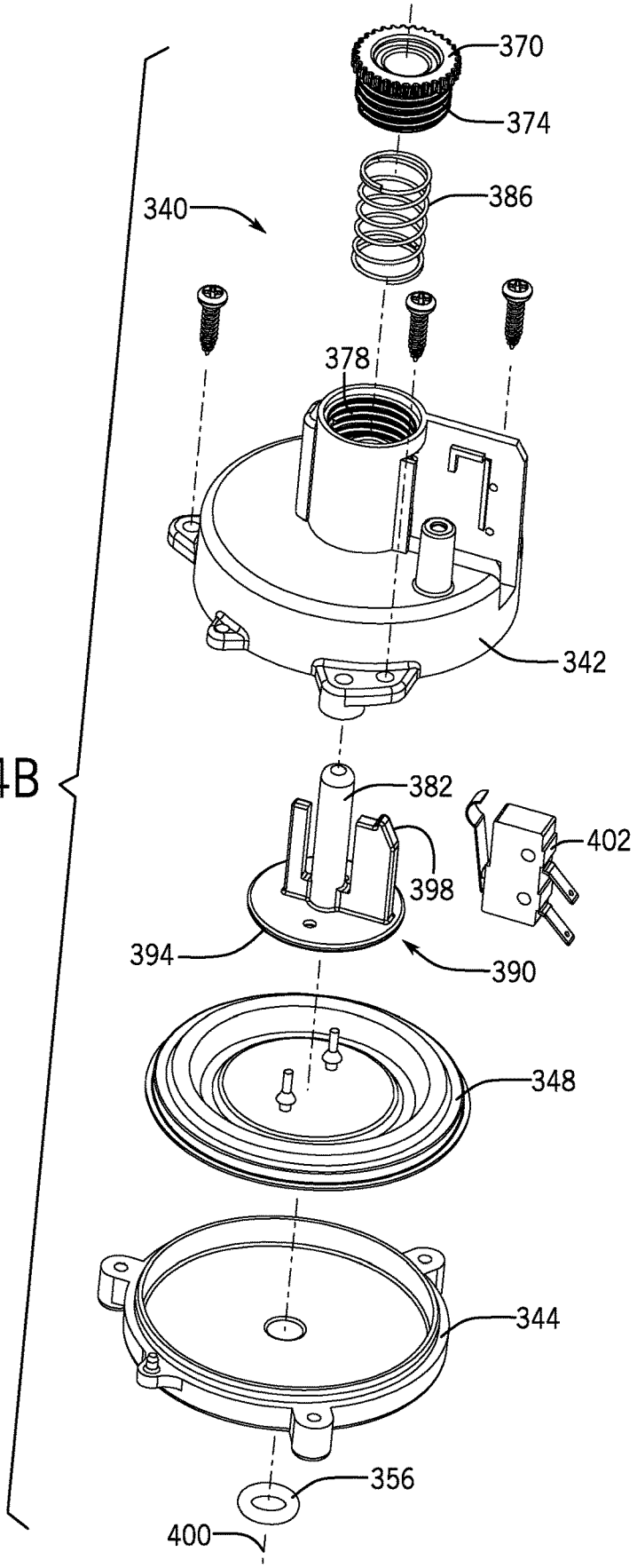
FIG. 14B is an exploded perspective view of the air pressure control assembly of FIG. 5A.
Figure 15A:
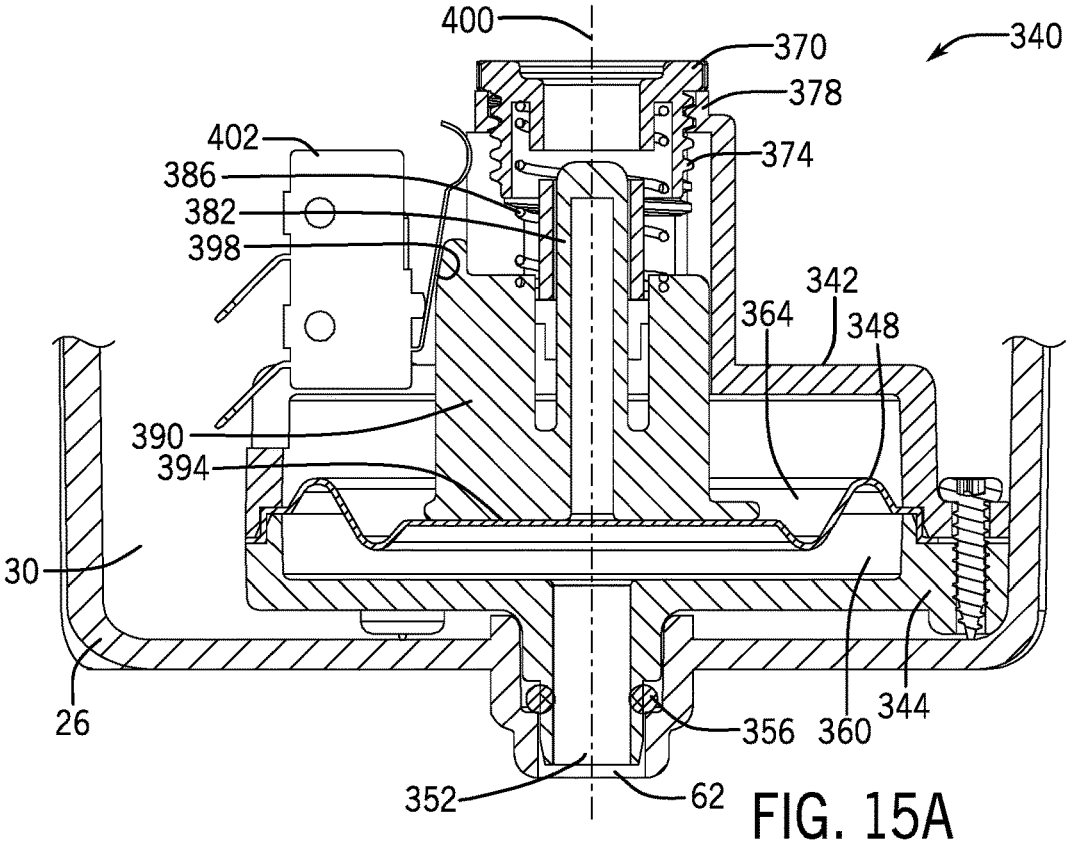
FIGS. 15A and 15B are cross-sectional views of the air pressure control assembly taken along the line 15A, 15B-15A, 15B shown in FIG. 14A, showing a flexible membrane in relaxed and expanded positions, respectively.
Figure 15B:
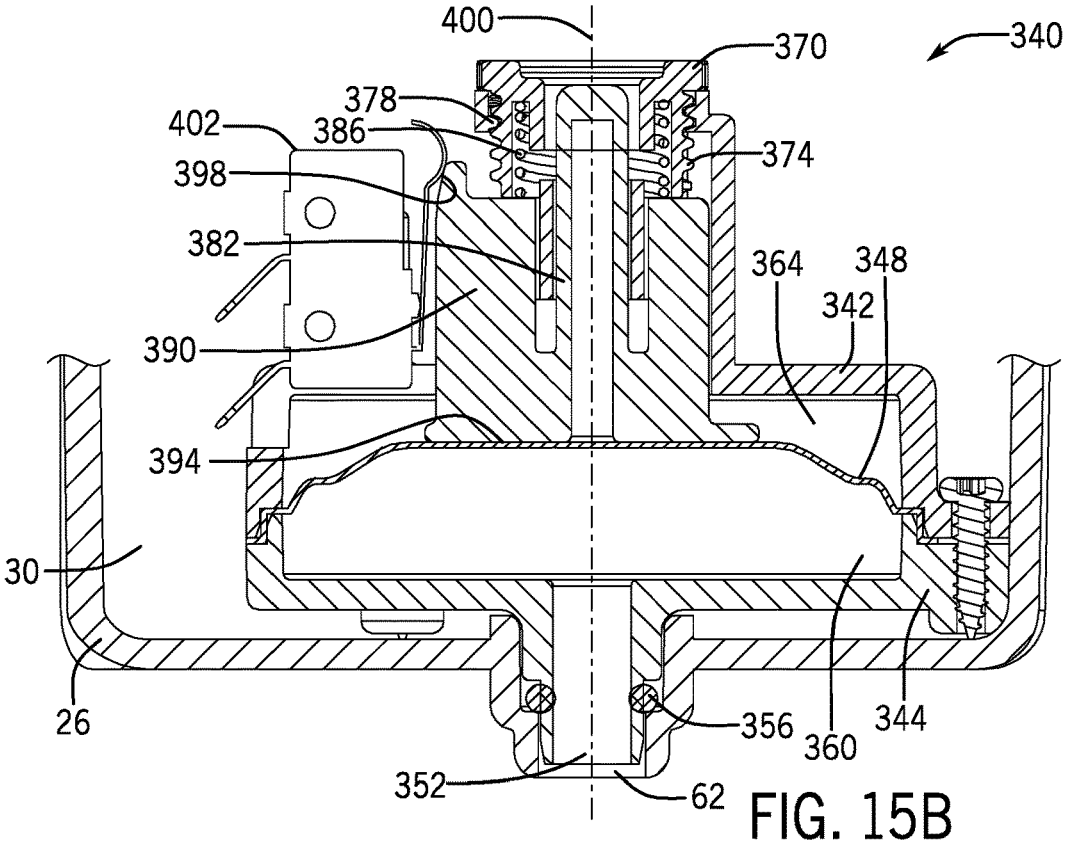

When the first one-way valve 58 is disposed in the closed position (FIG. 12A), the movable first arm 328 actuates the closed position signal generating device 320, as best shown in FIG. 13A. When the first one-way valve 58 is disposed in the open position (FIG. 12B), the movable second arm 332 actuates the open position signal generating device 324, as best shown in FIG. 13B.

An air pressure control assembly 340 is best shown in FIGS. 14A-15B. The air pressure control assembly 340 includes an air pressure control first housing 342, an air pressure control second housing 344 and a movable membrane 348. The movable membrane 348 can be at least partially disposed within the air pressure control first housing 342 and air pressure control second housing 344. In some implementations a portion of the movable membrane 348, which can be a perimeter of the movable membrane 348, is disposed between, or substantially between, the air pressure control first housing 342 and air pressure control second housing 344 when the air pressure control first housing 342 and air pressure control second housing 344 are assembled in the air pressure control assembly 340. Such an arrangement can be seen at least in FIGS. 15A and 15B.

An air pressure control assembly vent 352 is defined by the air pressure control second housing 344. The air pressure control assembly vent 352 is in fluid communication with the air pressure measurement vent 62 formed in the housing 26, and an air pressure control assembly seal 356 is disposed between the housing 26 and air pressure control second housing 344 to prevent, or substantially prevent, fluid from passing between the housing 26 and air pressure control second housing 344.

A first pressure chamber 360 is defined as an area substantially bounded by the movable membrane 348, air pressure control second housing 344, and a second pressure chamber 364 is defined as an area substantially bounded by the movable membrane 348 and the air pressure control first housing 342. The second pressure chamber 364 can be in fluid communication with the housing cavity 30. The first pressure chamber 360 and second pressure chamber 364 can be disposed on substantially opposed sides of the movable membrane 348. The first pressure chamber 360 is in fluid communication with the interior cavity 38 via the air pressure control assembly vent 352 and the air pressure measurement vent 62. The second pressure chamber 364 can be in fluid communication with the exterior of the inflatable member 18.

The air pressure control assembly 340 also includes a knob 370 having knob threads 374, housing threads 378 defined on a portion of the air pressure control first housing 342, an adjustment rod spring 386 and a translator 390. The translator 390 further defines a translator first surface 394, a portion of which is connected to, or contacts, the movable membrane 348, an adjustment rod 382, and a translator second surface 398. As a pressure in the interior cavity 38 rises, pressure correspondingly builds in the first pressure chamber 360 and acts on the movable membrane 348 to push the movable membrane 348 towards the air pressure control first housing 342. The movable membrane 348 acts on and causes the translator 390 to translate, the air pressure in the first pressure chamber 360 decreases as the air pressure in the interior cavity 38 decreases, and the translator 390 pushes the movable membrane 348 towards the air pressure control second housing 344 by the adjustment rod spring 386.

The knob 370 can be rotated relative to the air pressure control first housing 342 and, via the engaged housing threads 378 and knob threads 374, can translate longitudinally along a knob axis 400 when rotated. The adjustment rod spring 386, which can be sleeved around a portion of the adjustment rod 382, can exert different levels of force on the translator 390 due to various positions of the knob 370. Accordingly, the movable membrane 348 and translator 390 encounter different levels of mechanical resistance due to the longitudinal position of the knob 370 along the knob axis 400.

The translator second surface 398 can actuate an air pressure signal generating device 402 when the translator 390 reaches a certain position along the knob axis 400. By this system, when the interior cavity is inflated, a given interior cavity 38 pressure causes the movable membrane 348 and translator 390 to translate along the knob axis 400. If the translator 390, and thus the translator second surface 398, move sufficiently to actuate the air pressure signal generating device 402, the first or second air pressure signal is generated and transmitted by the air pressure signal generating device 402. In other words, the required interior cavity pressure 38 for actuating the air pressure signal generating device 402 can be altered by a rotation of the knob 370.

Figure 16:
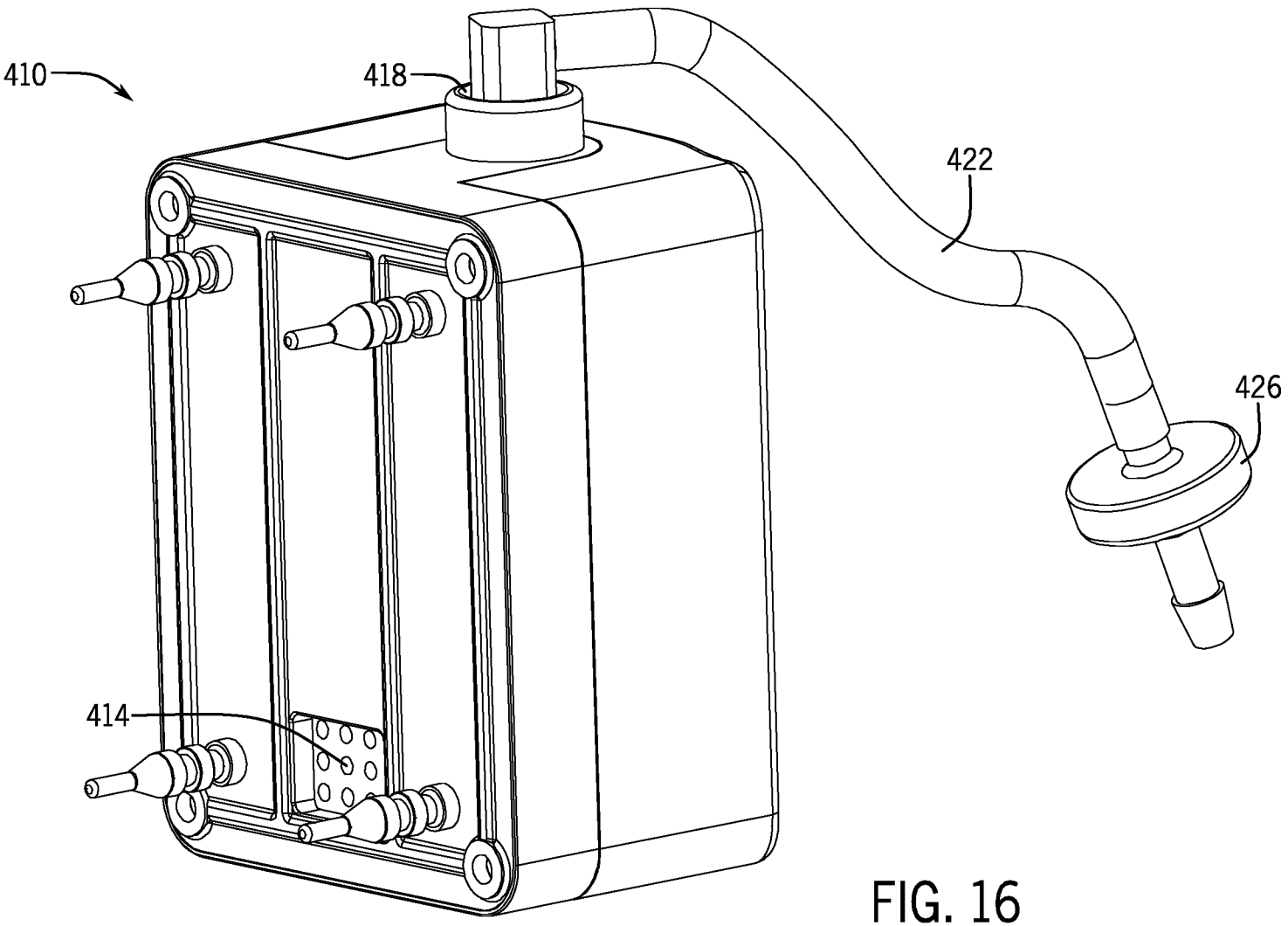
FIG. 16 is a perspective view of the supplementary pump of FIG. 5A.
Figure 17:
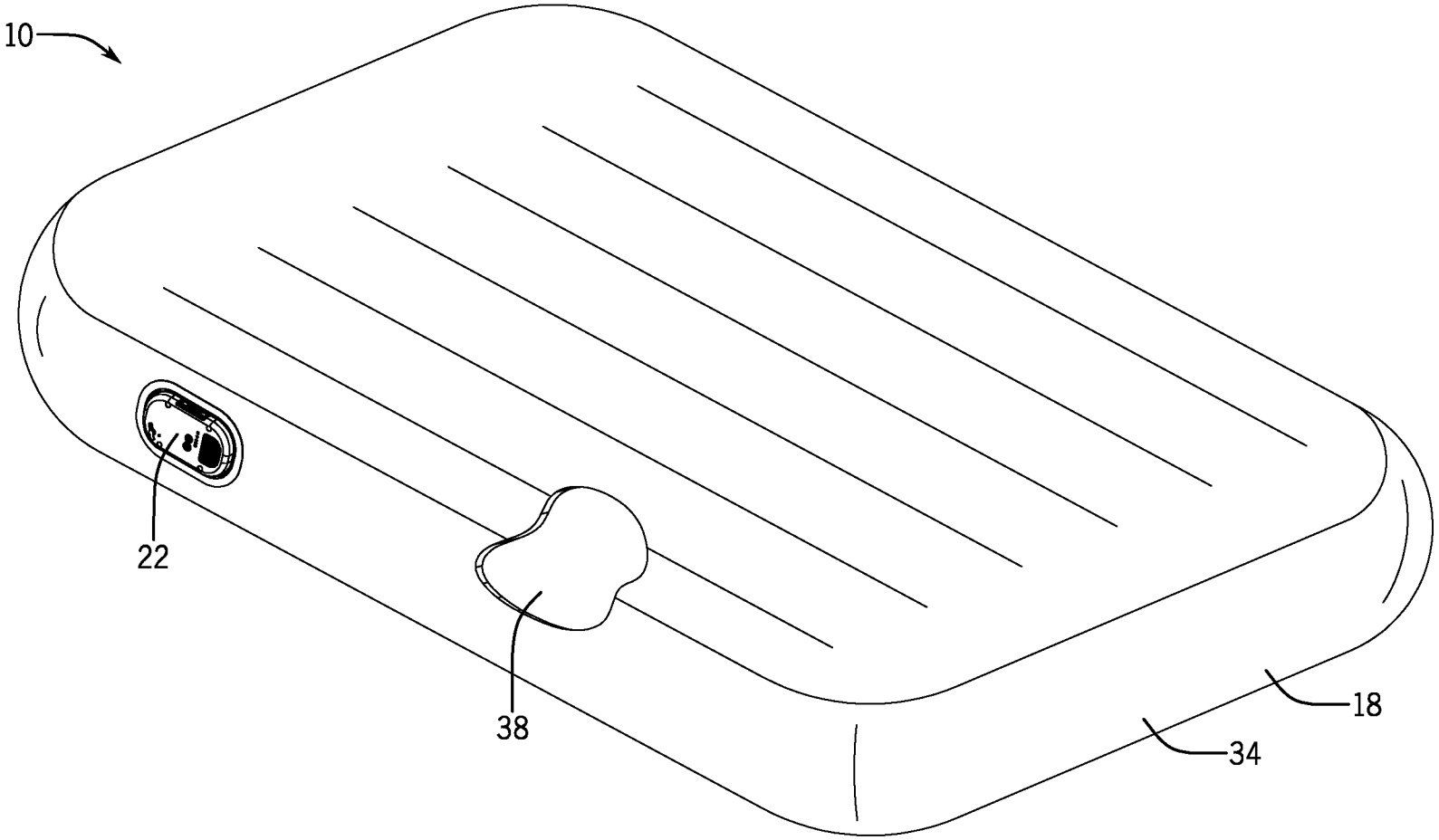
FIG. 17 is a perspective view of the air pump system mounted on an inflatable member according to exemplary implementations of the present disclosure, also showing an interior cavity.

A supplementary pump 410 is best shown in FIG. 16. The supplementary pump 410 includes a supplementary inlet 414 in fluid communication with the housing cavity 30, and further includes a supplementary outlet 418. The supplementary outlet 418 is in fluid communication with the interior cavity 38 via an outlet tube 422, a second one-way valve 426 and the air supplementing vent 66. The second one-way valve 426 can be disposed in, or proximate, the air supplementing vent 66. In some implementations, the supplementary pump 410 can include, or comprise, a mute diaphragm pump.

Exemplary operations of the air pump system 10 will now be described. As disclosed above, the control device 174 can be in electrical communication with elements of the air pump system 10 including, but not limited to, the charging port 140, battery 144, battery charge indicator 148, charging indicator 152, battery charge indicator control 156, electrical energy-outputting port 160, initiating device 168, main pump motor 210, valve control motor 246, closed position signal generating device 320, open position signal generating device 324, air pressure signal generating device 402 and supplementary pump 410. It is to be understood that the control device 174 can be a control circuit including a processor, memory and power supply control circuit, and further can be in communication with the above-mentioned elements of the air pump system 10 via a communications bus, wireless communications or wired communications.

Initially, when the initial pressure in the inflation member 18 is below a first threshold pressure, for example, when the inflation member 18 is in a non-inflated state or the user partially inflates the inflation member 18 using a hand pump or electrical pump, but the air pressure does not reach the first threshold pressure, the user can operate the initiating device 168 disposed on the cover 22. Such an operation is conveyed to the control device 174 which generates and transmits an open signal to the valve control motor 246 to open the first one-way valve 58 and instructs the main pump motor 210 to operate. As the main pump motor 210 operates when the first one-way valve 58 is open, a pressure differential created by the rotating main pump fan 222 draws air from the exterior of the air pump system 10 through the cover vent 176, through the main pump inlet 198 and main pump outlet 206, through the valve control assembly inlet 238 and valve control assembly outlet 242, through the first vent 54 and finally into the interior cavity 38 of the inflatable member 18. The open position signal generating device 324 generates an open position signal when the first one-way valve 58 is opened, and transmits the open position signal to the control device 174. The control device 174 then generates and transmits a stop signal to the valve control motor 246 to stop operating.

These operations cause the pressure and/or volume of air inside the inflatable member 18 to rise until a first threshold pressure is reached. The first threshold pressure can be 240 mm $H_2O$, or approximately 240 mm $H_2O$. Exemplarily, the first and second threshold air pressures can be altered via knob 370 adjustments, and an actuation of the air pressure signal generating device 402 by the translator second surface 398 is caused when the first threshold pressure is reached in the first pressure chamber 360 and interior cavity 38. Once the first threshold pressure is reached, the air pressure signal generating device 402 generates a first air pressure signal and transmits this signal to the control device 174.

Upon receipt of the first air pressure signal, the control device 174 generates and transmits a stop signal to the main pump motor 210 to stop operating and/or generates and transmits a close signal to the valve control motor 246 to close the first one-way valve 58. In detail, the control device 174 generates and transmits a close signal to the valve control motor 246, which causes the valve control motor 246 to operate to close the first one-way valve 58 until a closed position signal, generated by the closed position signal generating device 320, is transmitted to the control device 174 and the control device 174 generates and transmits a stop signal to the valve control motor 246.

Subsequently, if the pressure in the interior cavity 38, as sensed by the air pressure control assembly 340, falls to a second threshold pressure, the air pressure signal generating device 402 generates a second air pressure signal and transmits this signal to the control device 174. The second threshold pressure can be 200 mm $H_2O$, or approximately 200 mm $H_2O$. At this time, the control device 174 generates and transmits a supplementary operation signal to the supplementary pump 410. The supplementary pump 410 can then operate to increase the pressure in the interior cavity 38 until the first threshold pressure is once again reached, and the air pressure signal generating device 402 generates the first air pressure signal and transmits this signal to the control device 174. The control device 174 can then generate and transmit a supplementary stop signal to the supplementary pump 410. When the air pressure sensed by the air pressure control assembly 340 further decreases to the second threshold air pressure, the above operation is repeated.

It is to be understood that the control device 174 can be disposed on any element of the air pump system 10. It is also to be understood that the control device 174 can represent a decentralized set of electronic communication elements located within, or on, different elements of the air pump system 10, and such electronic communication elements may constitute a control circuit.

In some implementations, a time required for the opening and/or closing of the first one-way valve 58 by the valve control motor 246 can be ascertained in advance. Accordingly, after the valve control motor 246 has operated for the certain required time period, the control device 174 can command the valve control motor 246 to stop operating. Such an implementation could preclude signal generating devices 320, 324 of the valve control assembly 230.

In summary, the supplementary pump 410 starts operating when the control device 174 has transmitted the stop signal to the main pump 190 and the air pressure sensed by the air pressure control assembly 340 reaches the second threshold air pressure.

In the disclosed air pump system 10, electrical components including, but not limited to, the main pump 190, battery 144, valve control assembly 230, air pressure control assembly 340, supplementary pump 410, control device 174 and features of the cover 22, are isolated from inflation fluid flows. As fluids, such as air, water and other gasses or liquids, can potentially damage these electrical elements, the disclosed air pump system advantageously prevents such damage, thus increasing product longevity and marketability. Further, the waterproof plugs 164 can prevent fluids from entering the air pump system 10.

Any of the above-described elements can include a flexible thermoplastic material or a rigid material, and further elements can be connected by one or more of high frequency welding, adhesion and any other mechanical attachment system commonly known to those skilled in the art. Additionally, it is to be understood that all described elements and features in this disclosure can be formed of any number of materials including, but not limited to, polymers, plastics, rubbers, foams, vinyl, PVC, coated fabric, metals, metal alloys or any other suitable material known to those skilled in the art.

While some implementations have been illustrated and described, numerous modifications come to mind without significantly departing from the spirit of the disclosure, and the scope of protection is only limited by the scope of the accompanying claims.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled. Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "said" and similar references in the context of describing the invention (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

What is claimed is:

1. An air pump system, comprising:

a housing defining a first vent in fluid communication with an interior cavity of an inflatable member;

a first one-way valve configured to open or close the first vent;

a main pump having a main pump inlet and a main pump outlet, the main pump inlet being in fluid communication with an exterior of the inflatable member and the main pump outlet being in fluid communication with the interior cavity via the first vent;

a valve control assembly for selectively opening or closing the one-way valve, the valve control assembly transmitting a closed position signal when the one-way valve is in a closed position and the valve control assembly transmitting an open position signal when the one-way valve is in an open position;

an air pressure control assembly for sensing an air pressure of the interior cavity and generating a first air pressure signal when the air pressure reaches a first threshold air pressure, and generating a second air pressure signal when the air pressure reaches a second threshold air pressure;

a control device in electrical communication with the main pump, valve control assembly and the air pressure control assembly, the control device configured to transmit an operation signal to the main pump to operate when the air pressure sensed by the air pressure control assembly is below the first threshold air pressure and the control device configured to transmit a stop signal to the main pump to cease operating when the air pressure sensed by the air pressure control assembly reaches the first threshold air pressure;

a supplementary pump having a supplementary inlet in fluid communication with the exterior of the inflatable member and a supplementary outlet in fluid communication with the interior cavity via an air-supplementing vent in the housing, the supplementary pump being in electrical communication with the control device; and a base disposed on an outer surface defined by the inflatable member, said base being at least partially disposed in the interior cavity, the base releasably securing one or more of the housing, first one-way valve, main pump, valve control assembly, supplementary pump and air pressure control assembly to the inflatable member;

wherein the base defines a base vent in fluid communication with the interior cavity and the first vent.

2. The air pump system of claim 1, wherein after the control device has transmitted the stop signal to the main pump to cease operating and the air pressure sensed by the air pressure control assembly reaches the second threshold air pressure, the control device transmits a supplementary operation signal to the supplementary pump to operate, and the control device transmits a supplementary stop signal to the supplementary pump to cease operating when the air pressure sensed by the air pressure control assembly reaches the first threshold air pressure.

3. The air pump system of claim 1, wherein the air pump system further includes an initiating device manipulable by a user, the initiating device being in electrical communication with the control device.

4. The air pump system of claim 3, wherein the initiating device is disposed on a cover attached to the housing.

5. The air pump system of claim 3, wherein the control device transmits an open signal to the valve control assembly to open the first one-way valve when the initiating device is activated.

6. The air pump system of claim 3, wherein the control device transmits the operation signal to the main pump to operate when the initiating device is activated.

7. The air pump system of claim 1, the air pump system further including a battery in electrical communication with the control device.

8. The air pump system of claim 7, wherein a cover is attached to the housing, the cover including at least one of a charging port for supplying electrical energy to a rechargeable battery and an electrical energy-outputting port for supplying electrical energy to an external device.

9. The air pump system of claim 8, wherein a battery indicator indicates a state of charge of the battery.

10. The air pump system of claim 9, wherein a battery indicator control switch selectively turns on and off the battery indicator.

11. The air pump system of claim 1, wherein an actuation of a closed position signal generating device in the valve control assembly generates the closed position signal and an actuation of an open position signal generating device in the valve control assembly generates the open position signal.

12. The air pump system of claim 11, wherein the valve control assembly includes a movable first arm for actuating the closed position signal generating device to generate the closed position signal.

13. The air pump system of claim 11, wherein the valve control assembly includes a movable second arm for actuating the open position signal generating device to generate the open position signal.

14. The air pump system of claim 12, wherein the air pressure control assembly includes a movable membrane assembly configured to generate displacement due to air pressure of the interior cavity and an external air pressure of the inflatable member, and an air pressure signal generating device for generating and transmitting the first or second air pressure signal, the air pressure signal generating device being activated by the movable membrane assembly.

15. The air pump system of claim 1, wherein the air pressure control assembly includes a movable membrane assembly and an air pressure signal generating device, wherein, the movable membrane assembly is configured to generate displacement due to an air pressure of the interior cavity and an external air pressure of the inflatable member, the air pressure signal generating device being in electrical communication with the control device, the membrane assembly is further configured to activate the air pressure signal generating device to generate the first air pressure signal when the air pressure of the interior cavity reaches the first threshold air pressure and to activate the air pressure signal generating device to generate the second air pressure signal when the air pressure of the interior cavity reaches the second threshold air pressure.

16. The air pump system of claim 1, further comprising a lock structure for releasably securing one or more of the housing, cover, first one-way valve, main pump, valve control assembly, air pressure control assembly, control device and supplementary pump into the base.

17. The air pump system of claim 11, wherein the valve control assembly includes:

a motor electrically coupled to the control device and an actuating mechanism coupled to the motor, wherein the motor is configured to drive the actuating mechanism, the actuating mechanism being configured to actuate the first one-way valve to translate in an axial direction of the first vent to open or close the first vent, the actuating mechanism being configured to activate the closed position signal generating device to generate the closed position signal and to activate the open position signal generating device to generate the open position signal.

18. The air pump system of claim 17, wherein, the motor includes a motor shaft;

the actuating mechanism includes at least one gear member; and a rotatable cam is configured to rotate about a cam rotation axis, wherein the rotatable cam defines a cam surface and a gear portion, and wherein the motor shaft is coupled to the at least one gear member for rotating the at least one gear member, and wherein at least one of the gear members is engaged with the gear portion so as to rotate the rotatable cam and thereby open or close the first vent through contact between the rotatable cam and a valve rod of the first one-way valve, the contact translating a valve plate of the first one-way valve along a first vent axis.

* * * * *